US008777224B2

(12) United States Patent
Gadda et al.

(10) Patent No.: US 8,777,224 B2
(45) Date of Patent: Jul. 15, 2014

(54) SYSTEM AND METHODS FOR DEALING A VIDEO CARD

(75) Inventors: Christian E. Gadda, Las Vegas, NV (US); Chauncey W. Griswold, Reno, NV (US); Harold E. Mattice, Gardnerville, NV (US); James W. Stockdale, Clio, CA (US); Richard L. Wilder, Sparks, NV (US)

(73) Assignee: IGT, Las Vegas, NV (US)

( * ) Notice: Subject to any disclaimer, the term of this patent is extended or adjusted under 35 U.S.C. 154(b) by 1339 days.

(21) Appl. No.: 11/983,467

(22) Filed: Nov. 9, 2007

(65) Prior Publication Data

US 2009/0124321 A1 May 14, 2009

(51) Int. Cl.
*A63F 9/24* (2006.01)

(52) U.S. Cl.
USPC ..... 273/149 R; 273/309; 463/16; 463/30

(58) Field of Classification Search
USPC ..... 273/149 R, 309; 463/16–20, 30, 31
See application file for complete search history.

(56) References Cited

U.S. PATENT DOCUMENTS

| | | | | |
|---|---|---|---|---|
| 5,941,769 | A * | 8/1999 | Order | 463/12 |
| 6,039,650 | A * | 3/2000 | Hill | 463/47 |
| 6,299,536 | B1 * | 10/2001 | Hill | 463/47 |
| 6,504,530 | B1 | 1/2003 | Wilson et al. | |
| 6,522,264 | B1 | 2/2003 | Stewart | |
| 6,582,301 | B2 * | 6/2003 | Hill | 463/11 |
| 6,637,622 | B1 | 10/2003 | Robinson | |
| 7,029,009 | B2 * | 4/2006 | Grauzer et al. | 273/149 P |
| 7,042,440 | B2 | 5/2006 | Pryor et al. | |
| 7,049,965 | B2 | 5/2006 | Kelliher et al. | |
| 7,052,440 | B2 | 5/2006 | Pyles et al. | |
| 7,207,488 | B2 | 4/2007 | Hammerslag et al. | |
| 7,213,812 | B2 * | 5/2007 | Schubert et al. | 273/149 R |
| 7,255,642 | B2 | 8/2007 | Sines et al. | |
| 7,769,232 | B2 * | 8/2010 | Downs, III | 382/181 |
| 2001/0000118 | A1 * | 4/2001 | Sines et al. | 273/274 |
| 2003/0195025 | A1 * | 10/2003 | Hill | 463/11 |
| 2004/0023722 | A1 * | 2/2004 | Vuong et al. | 463/40 |
| 2004/0142736 | A1 * | 7/2004 | Karn et al. | 463/11 |
| 2005/0143157 | A1 * | 6/2005 | Stelzer et al. | 463/12 |
| 2005/0248729 | A1 | 11/2005 | Drucker et al. | |
| 2006/0036944 | A1 | 2/2006 | Wilson | |
| 2006/0066564 | A1 | 3/2006 | Yee et al. | |
| 2006/0092170 | A1 | 5/2006 | Bathiche et al. | |
| 2006/0211493 | A1 | 9/2006 | Walker et al. | |
| 2007/0010318 | A1 | 1/2007 | Risby et al. | |
| 2007/0015574 | A1 | 1/2007 | Vale et al. | |
| 2007/0178955 | A1 * | 8/2007 | Mills | 463/13 |
| 2007/0188444 | A1 | 8/2007 | Vale et al. | |
| 2007/0201863 | A1 | 8/2007 | Wilson et al. | |
| 2007/0211921 | A1 | 9/2007 | Popp et al. | |
| 2007/0213113 | A1 | 9/2007 | Dunaevsky et al. | |
| 2007/0259716 | A1 | 11/2007 | Mattice et al. | |

OTHER PUBLICATIONS

International Search Report, PCT/US 08/82408, dated Jan. 6, 2009 (2 pages).

* cited by examiner

*Primary Examiner* — Steve Rowland
(74) *Attorney, Agent, or Firm* — Foley & Lardner LLP

(57) ABSTRACT

A physical device that triggers a deal of a video card is described. The physical device triggers the deal when a subject moves an object of the subject on the physical device.

26 Claims, 11 Drawing Sheets

SYSTEM AND METHODS FOR DEALING A VIDEO CARD

BACKGROUND OF THE INVENTION

This invention relates generally to gaming systems and more particularly to systems and methods for dealing a video card.

Casinos and other forms of gaming makeup a growing multi-billion dollar industry both domestically and abroad, with table games continuing to be an immensely popular form of gaming and a substantial source of revenue for gaming operators. Such table games can include, for example, Poker, Blackjack, Baccarat, Craps, Roulette and other traditional standbys, as well as other more recently introduced games such as Pai-Gow, Carribean Stud, Spanish 21™, and Let It Ride™, among others. Under a typical gaming event at a gaming table, a player places a wager on a game, wherein a winning may be paid to the player depending on an outcome of the game. As is generally known, a wager may involve the use of cash, chips, markers, as well as various forms of claims. The game itself may involve the use of, for example, cards, dice, wheels, balls, or tokens, with the rules of the game and any payouts or pay tables being established prior to game play. Possible winnings may be paid in cash, credit, chips, markers, prizes, or other forms of payouts.

The gaming industry may employ playing card dispensers, such as shoes, to facilitate dealing of the cards in the game. In a card game of Blackjack, for example, a shoe is stocked with one or more decks of shuffled playing cards. Conventionally, a front panel of the shoe includes an opening extending upward from a bottom of the shoe through which the back of the next card to be dealt is exposed. To access the next card, a dealer slides fingers along the opening with a result that the next card is moved downward and out through a slot defined in the bottom of the shoe.

Known shoes are designed to be used with cards that can be touched and felt by the dealer. Hence, dealer may be able to manipulate the cards. For example, the dealer may be able to collude with a player to provide select cards to the player. As such, although known shoes may be adequate to play table games that use playing cards, improvements to the shoe are usually welcome and encouraged.

BRIEF DESCRIPTION OF THE INVENTION

In one aspect, a physical device that triggers a deal of a video card is described. The physical device triggers the deal when a subject moves an object of the subject on the physical device. The physical device may be attached to at least one identification indicia that uniquely identifies the physical device. The physical device is placed on a gaming table that displays a stack of video cards. Further, the physical device may be fabricated from a reflective material. For example, the physical device may be made of plastic or a combination of metal and plastic. The physical device may include a finger-slot that receives a movement of a finger.

In another aspect, a system for dealing a video card is described. The system includes a gaming table having a display screen that displays a stack of video cards. The system further includes a physical device that is placed on the gaming table and that may move on the gaming table. The system also includes a processor that triggers a deal of one of the video cards from the stack upon receiving an indication that an object of a subject moves on the physical device. The processor deals the one of the video cards from the stack upon receiving information that the object moves on the physical device and contacts the gaming table. The system further includes a sensor system that senses a placement of the physical device on the gaming table. The sensor system may sense the placement from an identification indicia attached to the physical device. The sensor system generates a signal upon sensing a placement of the physical device on the gaming table. The processor instructs to display the stack of video cards upon receiving the signal from the sensor system.

In yet another aspect, a system including a gaming table, a physical device, a sensor system and a processor is described. The sensor system generates a first signal upon sensing contact of the object with the physical device. The sensor system generates a second signal upon sensing contact of the object with the gaming table. The processor deals the one of the video cards upon receiving the first and second signals and upon determining that the object has a parameter within a range.

In still another aspect, a system for dealing a video card is provided. The system includes a gaming table, a first physical device that is placed on the gaming table, a second physical device that is placed on the gaming table, and a processor that deals one of a plurality of video cards from a first stack upon determining that an object moves on the physical device. The gaming table displays a second stack of video cards upon placement of the second physical object on the gaming table. The first stack may be used to play a card game that is different than a card game played by using the second stack. Moreover, the physical device may have a nonabrasive surface that is contact with the gaming table.

In another aspect, a method for dealing a video card is described. The method includes placing a physical device on a gaming table and triggering a deal of one of a plurality of video cards from a stack of video cards upon determining that an object moves on the physical device. The method further includes determining whether the object contacts the gaming table and dealing the one of the video cards upon determining that the object contacts the gaming table.

In still another aspect, a method for dealing a video card is described. The method includes placing a physical device on a gaming table and dealing one of a plurality of video cards from a stack upon determining that an object of a subject moves on the physical device. The method further includes determining whether a time period between the dealing and a trigger of a deal of another one of the video cards is within a time window. The method includes preventing dealing of the other one of the video cards upon determining that the time period is within the time window.

DETAILED DESCRIPTION OF THE INVENTION

Figure 1:
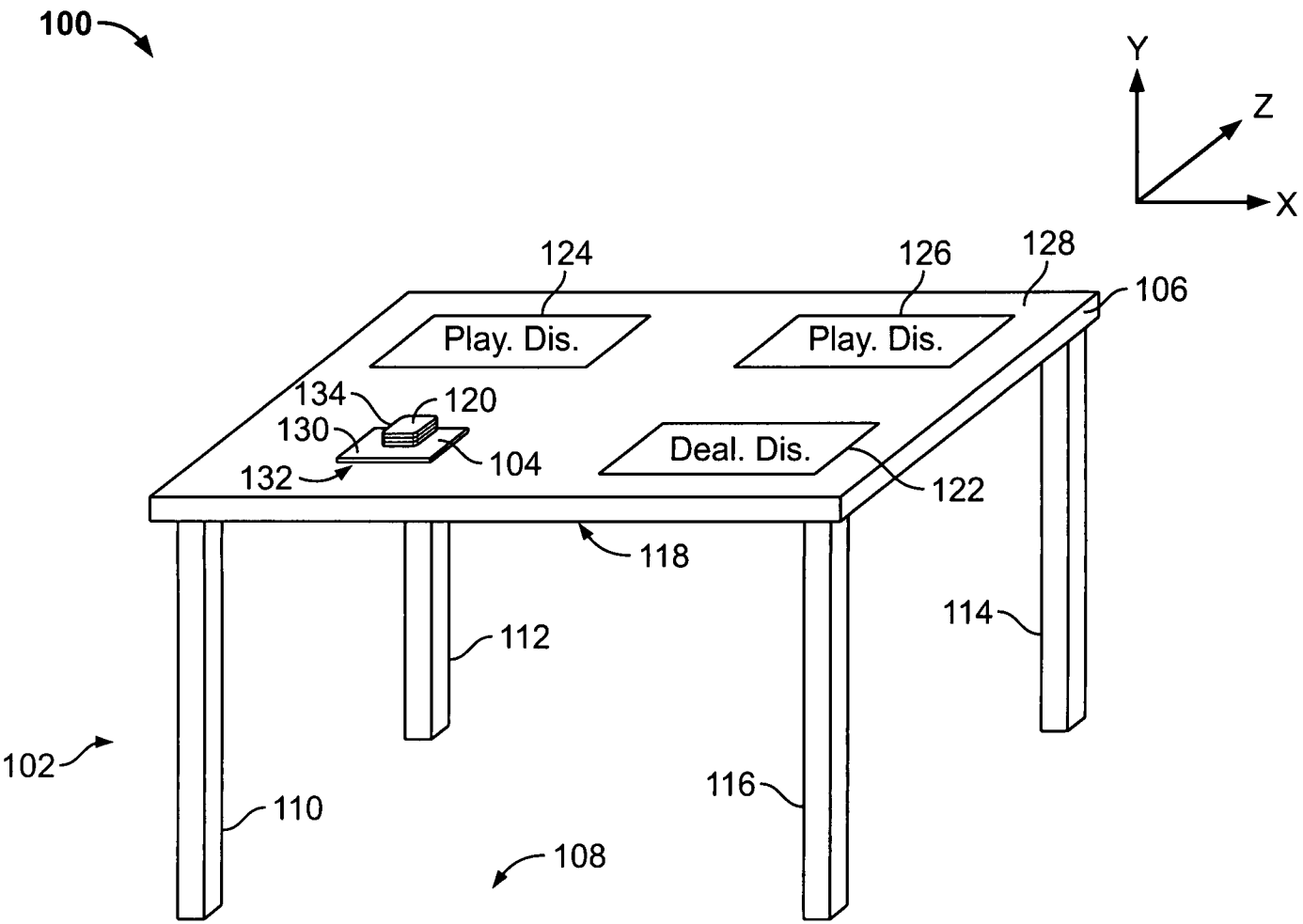
FIG. 1 is a perspective view of an exemplary system for dealing a video card.

FIG. 1 is a perspective view of an embodiment of an exemplary 100 for dealing a video card. In the exemplary embodiment, system 100 includes a gaming table 102 and a physical device 104. Gaming table 102 has a display screen 106 that is supported on a floor 108 by a plurality of legs 110, 112, 114, and 116. Floor 108 is located within a facility, such as a hotel, a casino, an airport, or a restaurant. A bottom surface 118 of display screen 106 may be coated with a material that is translucent to light.

In the exemplary embodiment, display screen 106 is a video display screen that displays a stack 120 of video cards, a dealer display area 122, and a plurality of player display areas 124 and 126. Stack 120, dealer display area 122, and player display areas 124 and 126 are video images displayed on display screen 106. Stack 120 includes any number of decks, such as a single deck of fifty-two video cards, a double, or a triple deck of video cards.

Dealer display area 122 is an area defined on a top surface 128 of display screen 106 and may include a display of at least one video card from stack 120 that is dealt to a dealer. Each player display area 124 and 126 includes an area defined on top surface 128 that may include a display of at least one video card from stack 120 dealt to a player who is playing a video card game at the gaming table 102. Examples of a video card game include Blackjack, Poker, and Rummy. Poker may be three card Poker, four card Poker, Texas Hold'em™, or Pai Gow Poker. Players who are playing at player display areas 124 and 126 play a video card game at player display areas 124 and 126 by either standing near player display areas 124 and 126 within the facility, or by sitting on furniture, such as chairs or stools, near player display areas 124 and 126 within the facility. Moreover, each player display area 124 and 126 may include a display of a set of gaming chips (not shown) allocated to a player playing at the player display area and may include a display of a set of gaming chips (not shown) that the player bets while playing a video card game.

At least a portion of physical device 104 reflects light incident on physical device 104. Physical device 104 does not include a display screen, a display device, or any electrical circuit. For example, physical device 104 does not include a touch screen, a plasma screen, or a liquid crystal display (LCD) screen, which displays stack 120. As another example, physical device 104 does not include any buttons or electric switches that the dealer can contact to deal video cards. A bottom surface 132 of physical device 104 may be a non-abrasive surface that facilitates reducing the risks of physical device 104 scratching top surface 128 when physical device 104 is moved across top surface 128. An example of physical device 104 includes a dealing shoe used to deal a video card from stack 120.

The dealer, who usually stands near dealer display area 122, places physical device 104 on gaming table 102. Upon placing physical device 104 on gaming table 102, display screen 106 displays stack 120 of video cards. A player playing a video card game selectively bets gaming chips. A player receives an authorization to bet gaming chips upon providing an authorization to the dealer to debit money from the player's account, such as a credit or a debit account. For example, a player may provide cash to the dealer and in exchange the dealer provides gaming chips having the same monetary value as the cash to the player. As another example, a player authorizes the dealer to debit a monetary value from a credit or a debit account of the player and the dealer, upon receiving the authorization, provides gaming chips, having the same monetary value to the player.

The dealer deals one of the video cards from stack 120 after the player has placed a bet at player display area 124. The dealer triggers a deal or deals one of the video cards in stack 120 by moving, such as sliding, any of fingers, such as an index finger, a middle finger, or a thumb, of the dealer across an upper surface 130 of physical device 104. Upper surface 130 does not face top surface 128 but rather bottom surface 132 faces, and is in contact with, top surface 128. When the dealer triggers a deal of one of the video cards from stack 120 by moving a finger of the dealer on upper surface 130, the finger reaches an edge 134 of physical device 104 and touches, i.e., contacts, a portion of top surface 128.

When a dealer's finger 422 touches top surface 128, one of the video cards in stack 120 is dealt to either dealer display area 122, player display area 124, or player display area 126 based on a stage of a video card game being played. For example, in a game of Blackjack, when the dealer moves a finger across upper surface 130 after the dealer deals video cards from stack 120 to display areas 122 and 124 and after a player at player display area 126 indicates to the dealer to hit, the dealer deals one of the video cards in stack 120 to the player display area 126. In another example, in a game of Poker, when the dealer moves a finger across physical device 104 after an ante is placed at player display areas 124 and 126, the dealer deals or triggers a deal to player display area 124. A deal of one of the video cards in stack 120 to a display area moves the video card from stack 120 to the display area. For example, a deal of one of the video cards in stack 120 to dealer display area 122 moves the video card from stack 120 to the dealer display area 122. As another example, a deal of one of the video cards in stack 120 to player display area 124 moves the video card from stack 120 to the player display area 124.

In another embodiment, gaming table 102 includes more than four legs. In yet another embodiment, gaming table 102 includes a container (not shown) that supports gaming table 102 on floor 108. In still another embodiment, gaming table 102 includes a continuous frame that supports gaming table 102 on floor 108.

In another embodiment, display screen 106 does not include dealer display area 122. In still another embodiment, display screen 106 displays any number, such as one, three, or six, of player display areas. In yet another embodiment, display screen 106 displays any number of dealer display areas. In another embodiment, display screen 106 displays any number of stacks of video cards, In yet another embodiment, players playing at player display areas 124 and 126 play the same video card game. In still another embodiment, player playing at player display area 124 plays a different video card game than a video card game played by a player playing at player display area 126. For example, a player may play Blackjack at player display area 124 and another player may play Poker at player display area 126. In such an embodiment, display screen 106 displays two stacks of video cards, one for each video card game and one of the two stacks is used to deal cards in Blackjack, and another one of the two stacks is used to deal cards in Poker.

In another embodiment, instead of displaying gaming chips within player display areas 124 and 126, display screen 106 displays a set of chip placement areas (not shown), such as circular or rectangular areas, that indicate to a plurality of players that they can place physical gaming chips, such as gaming chips that include identification indicia, on the chip placement areas during play of a video card game. Examples of identification indicia include, but are not limited to, a radio frequency identification (RFID) code, a barcode, a radial code, and a matrix code.

In yet another embodiment, physical device 104 may be of any size or shape. For example, a cross-section of physical device 104 includes a curved portion. As another example, a cross-section of physical device 106 includes a polygonal portion. As yet another example, physical device 106 has a polygonal cross-section in at least one of an xy plane formed between an x axis and a y axis, an an xz plane formed between the x axis and a z axis, and a yz plane formed between the y axis and the z axis. As still another example, physical device 106 has a curved cross-section in at least one of the xy, yz, and xz planes. As yet another example, a cross-section of physical device 106 includes a combination of curved and polygonal portions. In still another embodiment, display screen 106 is of any size or shape. For example, a cross-section of display screen 106 is curved, such as elliptical or circular, in shape. As another example, a cross-section of display screen 106 is polygonal, such as square or pentagonal, in shape.

In yet another embodiment, gaming table 102 includes a gaming chip rack (not shown), which allows a subject, such as the dealer or an administrator of the facility, to conveniently store gaming chips used by the dealer in playing a video card game. The gaming chip rack is placed on dealer display area 122. In such an embodiment, gaming table 102 may also include a money drop slot. The dealer deposits cash received into the money drop slot when players purchase betting chips.

Figure 2:
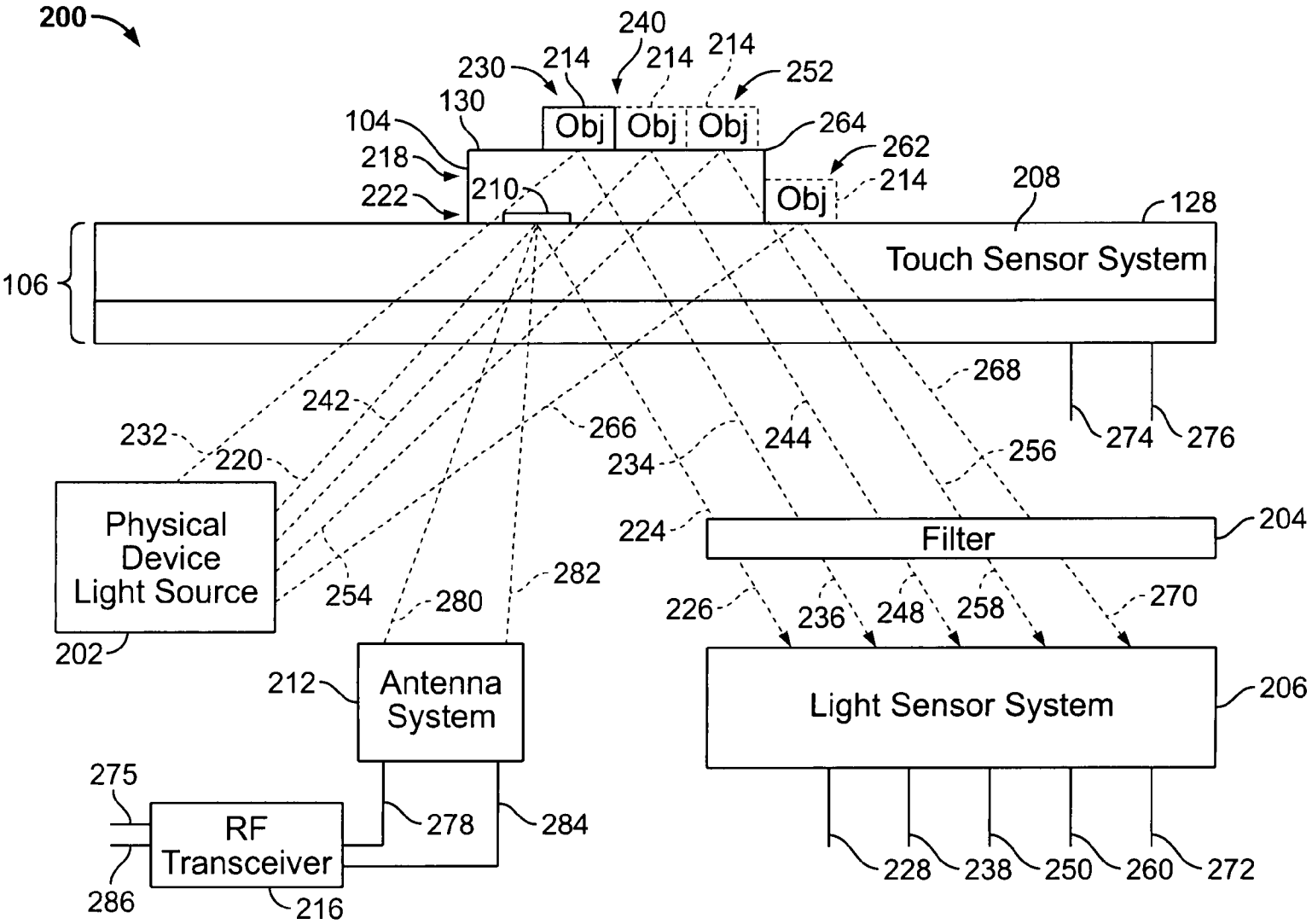
FIG. 2 is a block diagram of an exemplary system for dealing a video card.

FIG. 2 is a block diagram of an exemplary system 200 for dealing a video card. System 200 includes a light source 202, display screen 106, physical device 104, a filter 204, a light sensor system 206, a touch sensor system 208, an identification indicia 210, an antenna system 212, an object 214, and an RF transceiver 216.

Light source 202 may be an infrared light source that generates infrared light or an ambient light source, such as an incandescent light bulb or an incandescent light tube that generates ambient light, or a combination of the infrared light source and the ambient light source. An example of filter 204 includes an infrared-pass filter than filters light that is not infrared light.

Touch sensor system 208 is implemented within display screen 106. For example, touch sensor system 208 is located below and is in contact with display screen 106. An example of touch sensor system 208 includes one or more touch sensors (not shown) made from either capacitors or resistors.

Light sensor system 206 includes one or more sensors, such as optical sensors. For example, light sensor system 206 may be a charge coupled device (CCD) included within a digital video camera (not shown). As another example, light sensor system 206 includes photodiodes.

Identification indicia 210 may be a barcode, an RFID mark, a matrix code, or a radial code. Identification indicia 210 uniquely identifies physical device 104, which is attached to identification indicia 210. For example, identification indicia 210 includes encoded bits that have an identification value that is different than an identification value of another identification indicia attached to another physical device, similar to physical device 104. An example of the other physical device includes a dealing shoe 402 that is used to play a video card game. Moreover, identification indicia 210 is attached to and extends over at least a portion of a bottom surface 132 of physical device 104. For example, in one embodiment, identification indicia 210 is embedded within a laminate and the laminate is glued to bottom surface 132. As another example, identification indicia 210 is embedded within bottom surface 132. Identification indicia 210 reflects light that is incident on identification indicia 210. Light sensor system 206 detects light reflected from identification indicia 210 when indicia is facing light sensor system 206.

Antenna system 212 includes a set of antennas, such as an x-antenna that is parallel to the x axis, a y-antenna parallel to the y axis, and a z-antenna parallel to the z axis. RF transceiver 216 includes an RF transmitter and an RF receiver. Object 214 may be a finger of the dealer, a stylus used by the dealer, or a pen cap used by the dealer.

When physical device 104 is at a position 218 on top surface 128, light source 202 generates and emits a light 220 that is incident on at least a portion of physical device 104 and/or on identification indicia 210. When physical device 104 is at position 218, device 104 has an orientation 222. At least a portion of physical device 104 and/or identification indicia 210 reflects light 220 towards filter 204 to output light 224. Filter 204 receives light 224 reflected from identification mark 210 and/or at least a portion of physical device 104 via display screen 106 and filters the light to output a filtered light 226. If filter 204 includes an infrared-pass filter, filter 204 filters a portion of any light passing through filter 204 other than infrared light such that only the infrared light passes through filter 204. Light sensor system 206 senses filtered light 226 output from filter 204 and converts the light 226 into a physical-device-light-sensor-output signal 228, i.e., an electrical signal. Light sensor system 206 converts an optical signal, such as light, into an electrical signal.

Moreover, when object 214 is placed at an object position 230 that is in contact with upper surface 130, light source 202 generates and emits a light 232 that is incident on object 214 via physical device 104. Object 214 reflects light 232 that passes through physical device 104 and display screen 106 towards filter 204 to output a light 234. Filter 204 filters a portion of light 234 and outputs a filtered light 236. Light sensor system 206 senses the filtered light 236 output by filter 204 and outputs an object-light-sensor-output signal 238.

During game play, the dealer may move, such as slide, object 214 across upper surface 130 from object position 230 that is in contact with the upper surface 130 to an object position 240 that is in contact with the surface. When object 214 is moved across upper surface 130, from one position to another, object 214 may contact upper surface 130 for at least some time as it is moved. Object 214 can move on upper surface 130 in any of an x-direction parallel to the x axis, a y-direction parallel to the y axis, a z-direction parallel to the z axis, and a combination of the x, y, and z directions.

When object 214 is placed at object position 240 in contact with upper surface 130, light source 202 generates and emits a light 242 that is incident on object 214 via physical device 104. Object 214 reflects light 242 that passes through physical device 104 and display screen 106 towards filter 204 to output a light 244. Filter 204 filters a portion of light 244 to output a filtered light 248. Light sensor system 206 senses filtered light 248 output by filter 204 to output an object-light-sensor-output signal 250.

The dealer further moves object 214 across upper surface 130 from object position 240 to an object position 252 that is in contact with upper surface 130. When object 214 is placed at object position 252 in contact with upper surface 130 of physical device 104, light source 202 generates and emits a light 254 that is incident on object 214 via physical device 104. Object 214 reflects light 254 that passes through physical device 104 and display screen 106 towards filter 204 to output a light 256. Filter 204 filters a portion of light 256 to output a filtered light 258. Light sensor system 206 senses filtered light 236 output by filter 204 to output an object-light-sensor-output signal 260.

The dealer continues to move object 214 from object position 252 to an object position 262. When object 214 reaches an end 264 of physical device 104 and continues to be moved by the dealer from object position 240 or 252, the object 214 displaces to object position 262, which is in contact with top surface 128. Physical device edge 134 (shown in FIG. 1) is an example of end 264. When object 214 is placed at object position 262 in contact with a top surface 128 of physical device 104, light source 202 generates and emits a light 266 that is incident on object 214 via physical device 104. Object 214 reflects light 266 that passes through physical device 104 and display screen 106 towards filter 204 to output an light 268. Filter 204 filters a portion of light 268 to output a filtered light 270. Light sensor system 206 senses filtered light 270 output by filter 204 to output an object-light-sensor-output signal 272.

Touch sensor system 208 senses contact, such as a touch, of object 214 with top surface 128 at object position 262 to output an object-touch-sensor-output signal 274. Moreover, when physical device 104 is at position 218, touch sensor system 208 senses contact of physical device 104 with top surface 128 to output a physical-device-touch-sensor-output signal 276.

The RF transmitter of RF transceiver 216 receives an RF-transmitter-input signal 275 and modulates the RF-transmitter-input signal into an RF-transmitter-output signal 278, which is an RF signal. Antenna system 212 receives RF-transmitter-output signal 278 from the RF transmitter, converts the RF-transmitter-output signal 278 into a wireless RF signal and outputs the wireless RF signal as a wireless output signal 280. Identification indicia 210 receives wireless output signal 280 and responds to the signal by outputting an output signal 282, which is an RF signal. Antenna system 212 receives output signal 282 from identification indicia 210 and converts the signal into a wired RF signal that is output as a wired output signal 284 to the RF receiver of RF transceiver 216. The RF receiver receives wired output signal 284 and demodulates the signal to output a set 286 of RF-receiver-output signals.

In another embodiment, physical device 104 includes an electrical circuit. In yet another embodiment, system 200 does not include at least one of filter 204 and touch sensor system 208. In still another embodiment, touch sensor system 208 is located outside and on top surface 128. For example, touch sensor system 208 is a coated on top surface 128. In yet another embodiment, when object 214 moves on upper surface 130, from one position to another, object 214 may not be in contact with upper surface 130 for at least some time between the two positions.

In still another embodiment, light source 202 is located at another position relative to display screen 106. For example, light source 202 is located above top surface 128. In another embodiment, filter 204 and light sensor system 206 are located at another position relative to display screen 106. For example, filter 204 and light sensor system 206 are located above display screen 106. In another embodiment object position 240 is at physical device edge 264.

In yet another embodiment identification indicia 210 is a code, such as a barcode, a matrix code, or radial code, other than an RFID code. In such an embodiment, system 200 does not include RF transceiver 216 and antenna system 212. In another embodiment, system 200 does not include object position 252.

Figure 3:
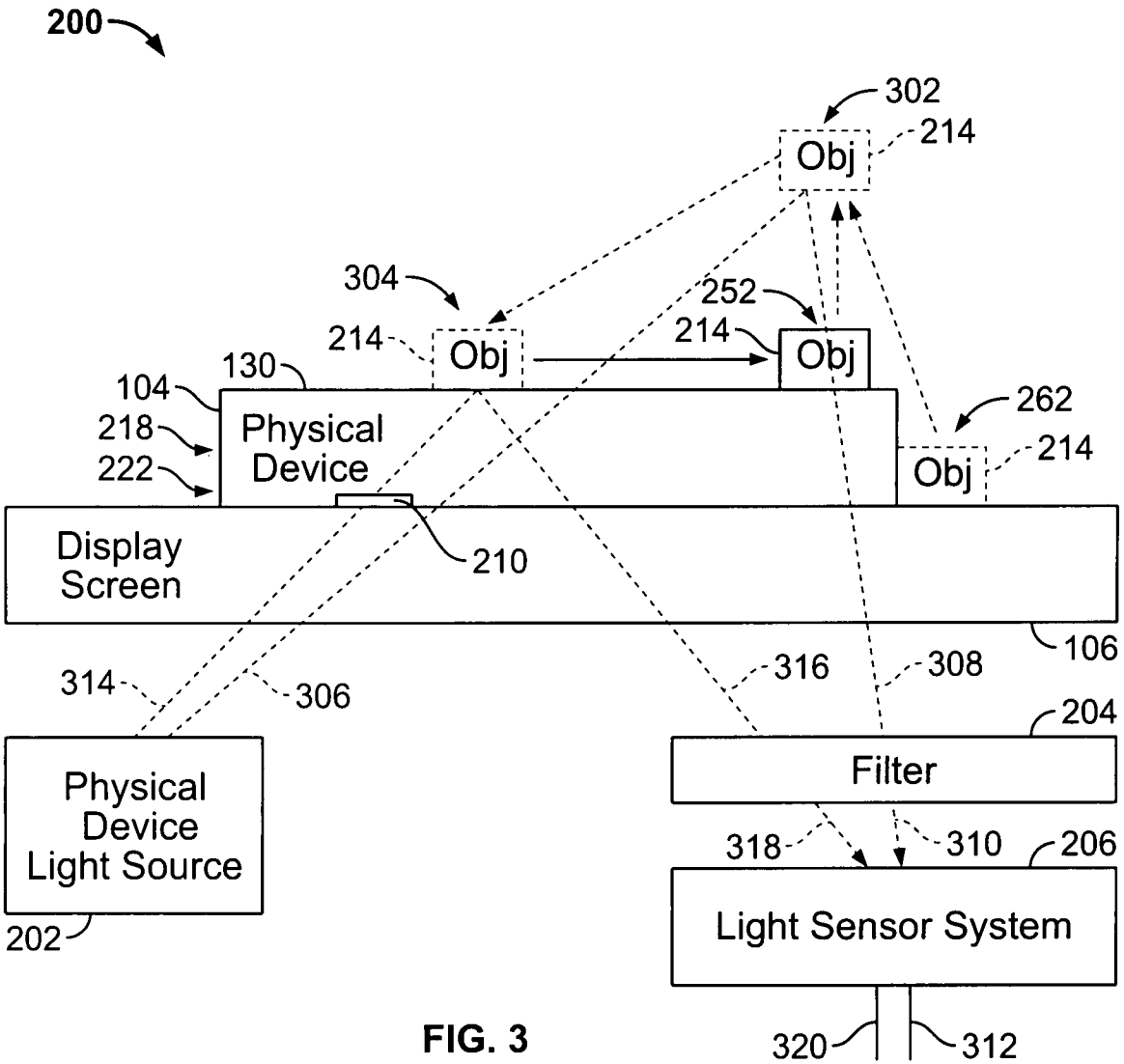
FIG. 3 is a block diagram of an alternate embodiment of the system of FIG. 2.

FIG. 3 is a block diagram of another embodiment of system 200 of FIG. 2. The dealer moves object 214 from object position 262 to an object position 302 that is not in contact with upper surface 130 or top surface 128. The dealer further moves object 214 from object position 302 to an object position 304. At object position 304, object 214 is in contact with upper surface 130. Object position 304 may be the same as object position 230 (shown in FIG. 2).

When object 214 is placed at object position 302, light source 202 generates and emits a light 306 that is incident on object 214 via physical device 104. Object 214 reflects light 306 that passes through physical device 104 and display screen 106 towards filter 204 to output a light 308. Filter 204 filters a portion of light 308 to output a filtered light 310. Light sensor system 206 senses filtered light 310 output by filter 204 and outputs an object-light-sensor-output signal 312.

Moreover, when object 214 is placed at object position 304 that is in contact with upper surface 130, light source 202 generates and emits a light 314 that is incident on object 214 via physical device 104. Object 214 reflects light 314 that passes through physical device 104 and display screen 106 towards filter 204 to output a light 316. Filter 204 filters a portion of light 316 to output a filtered light 318. Light sensor system 206 senses filtered light 318 output by filter 204 and outputs an object-light-sensor-output signal 320.

In another embodiment, the dealer moves object 214 from object position 252 to object position 302 without moving object 214 to object position 262. In yet another embodiment, dealer moves object 214 from object position 240 (shown in FIG. 2) to object position 302 without moving object 214 to object position 262. In still another embodiment, when light generated by light source 202 does not reach object 214 at object position 302, light sensor system 206 does not output object-light-sensor-output signal 312.

In FIGS. 2 and 3, physical device 104 is at position 218 with respect to an origin of an xyz coordinate system formed by the x, y, and z axes. The origin may be located at a vertex of display screen 106 or at a point within display screen 106, such as the centroid of display screen 106. Moreover, in FIGS. 2 and 3, physical device 104 has orientation 222 with respect to the origin. Moreover, in FIGS. 2 and 3, any of object positions 230, 240, 252, 262, 302, and 304 is with respect to the origin.

Figure 4:
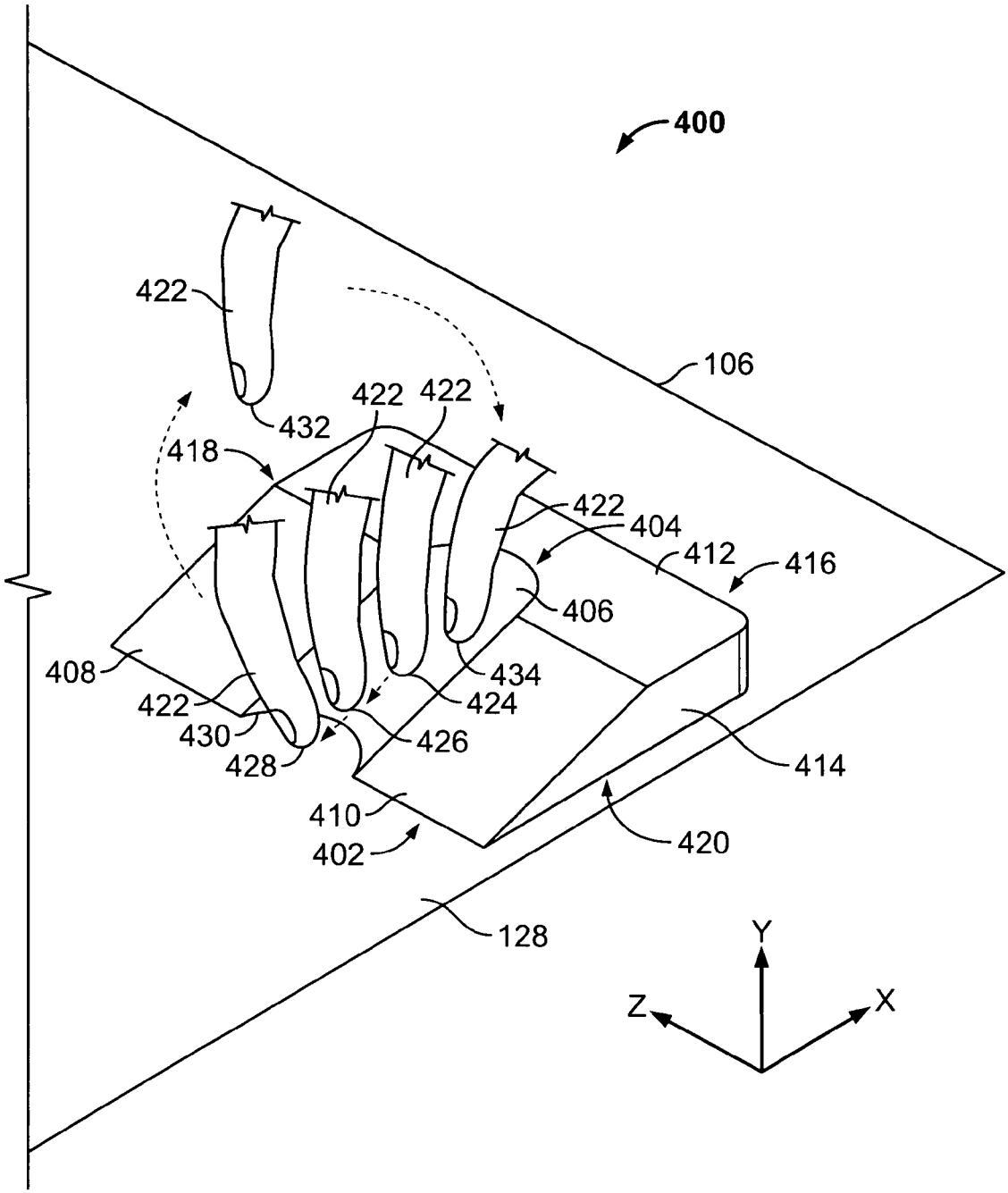
FIG. 4 is a perspective view of an alternate embodiment of a system for dealing a video card.

FIG. 4 is an isometric view of an embodiment of a system 400 for dealing a video card. System 400 includes a dealing shoe 402 and display screen 106. Dealing shoe 402 is an example of physical device 104 (shown in FIGS. 2 and 3). Dealing shoe 402 includes a fingerslot 404. Fingerslot 404 has a fingerslot surface 406 that is locate between two angled surfaces 408 and 410 of dealing shoe 402. Fingerslot surface 406 is fabricated from a material, such as plastic, that is reflective of light that is incident on the surface. Fingerslot surface 406 is an example of upper surface 130 (shown in FIGS. 2 and 3). Each angled surface 408 and 410 forms an angle greater than zero degrees, such as an angle ranging from zero and sixty degrees, with respect to top surface 128. Fingerslot surface 406 has a curved cross-section in the yz plane.

Dealing shoe 402 includes a non-angled surface 412 that forms an angle of zero degrees with respect to top surface 128. Non-angled surface 412 is adjacent to angled surfaces 408 and 410 and fingerslot surface 406, and angled surfaces 408 and 410 are adjacent to fingerslot surface 406.

Dealing shoe 402 further includes a plurality of dealing shoe side surfaces 414, 416, and 418, and a lower surface 420 of dealing shoe 402. Dealing shoe lower surface 420 is an example of bottom surface 132 (shown in FIG. 2). Each dealing shoe side surface 414, 416, and 418 forms an angle of ninety degrees with respect to top surface 128 when the dealer places dealing shoe 402 in contact with top surface 128.

Portions of dealing shoe 402 other than a portion including fingerslot surface 406 are made of an opaque material, such as plastic or a metal. For example, a portion including angled surface 408, a portion including angled surface 410, a portion including dealing shoe side surface 414, a portion including dealing shoe side surface 416, a portion including dealing shoe side surface 418, a portion including non-angled surface 412, and a portion including dealing shoe lower surface 420 are fabricated from a black acrylic.

The dealer moves a finger 422 of the dealer across fingerslot 404 from a position 424 to a position 426. Finger 422 is an example of object 214 (shown in FIG. 2). Position 424 is an example of object position 230 (shown in FIG. 2) and position 426 is an example of object position 240 (shown in FIG. 2). Finger 422 is in contact with fingerslot surface 406 at position 424 and at position 426. During movement of finger 422 from position 424 to position 426, finger 422 is in contact with fingerslot surface 406 for at least some time.

The dealer moves finger 422 from position 426 to a position 428. At position 428, finger 422 is in contact with top surface 128. Position 428 is an example of object position 262 (shown in FIG. 2). When moving finger 422 from position 426 to position 428, the finger passes a dealing shoe edge 430 of dealing shoe 402. Dealing shoe edge 430 is an example of end 264 (shown in FIG. 2). During passage of finger 422 by dealing shoe edge 430, finger 422 contacts the edge.

The dealer moves finger 422 from position 428 to a position 432. At position 432, finger 422 is not in contact with fingerslot surface 406. Position 432 is an example of object position 302 (shown in FIG. 3).

The dealer further moves finger 422 from position 432 to a position 434. At position 434, finger 422 comes back in contact with fingerslot surface 406. Position 434 is an example of object position 304 (shown in FIG. 3). Dealing shoe 402 is made by placing a material, such as plastic or a combination of plastic and metal, with a molding machine that has the same shape as that of dealing shoe 402, and by heating and cooling the material.

In another embodiment, fingerslot surface 406 has a curved cross-section in the xz plane. In yet another embodiment, fingerslot surface 406 has a curved cross-section in an xy plane formed between the x and y axes. In still another embodiment, fingerslot surface 406 has a polygonal cross-section in at least one of the xy, yz, and xz planes. For example, fingerslot surface 406 has a polygonal cross-section in the xy plane, a polygonal cross-section in the xz plane, and a polygonal cross-section in the yz plane. In yet another embodiment, during passage of dealing shoe edge 430, finger 422 does not contact the edge.

In another embodiment, each angled surface 408 and 410 forms an angle of zero degrees with respect to top surface 128. In yet another embodiment, non-angled surface 412 forms an angle greater than zero degrees, such as an angle between zero and forty-five degrees, with respect to top surface 128. In another embodiment, each dealing shoe side surface 414, 416, and 418 forms an angle between forty-five and ninety degrees with respect to top surface 128 when the dealer places dealing shoe 402 in contact with top surface 128.

In still another embodiment, the portions of dealing shoe 402 other than the portion including fingerslot surface 406 are fabricated from a reflective material. In another embodiment, during movement of finger 422 from position 424 to position 426, finger 422 is not in contact with fingerslot surface 406 for at least some time between the positions. In yet another embodiment, during passage of dealing shoe edge 430, finger 422 does not contact with the edge.

Figure 5:
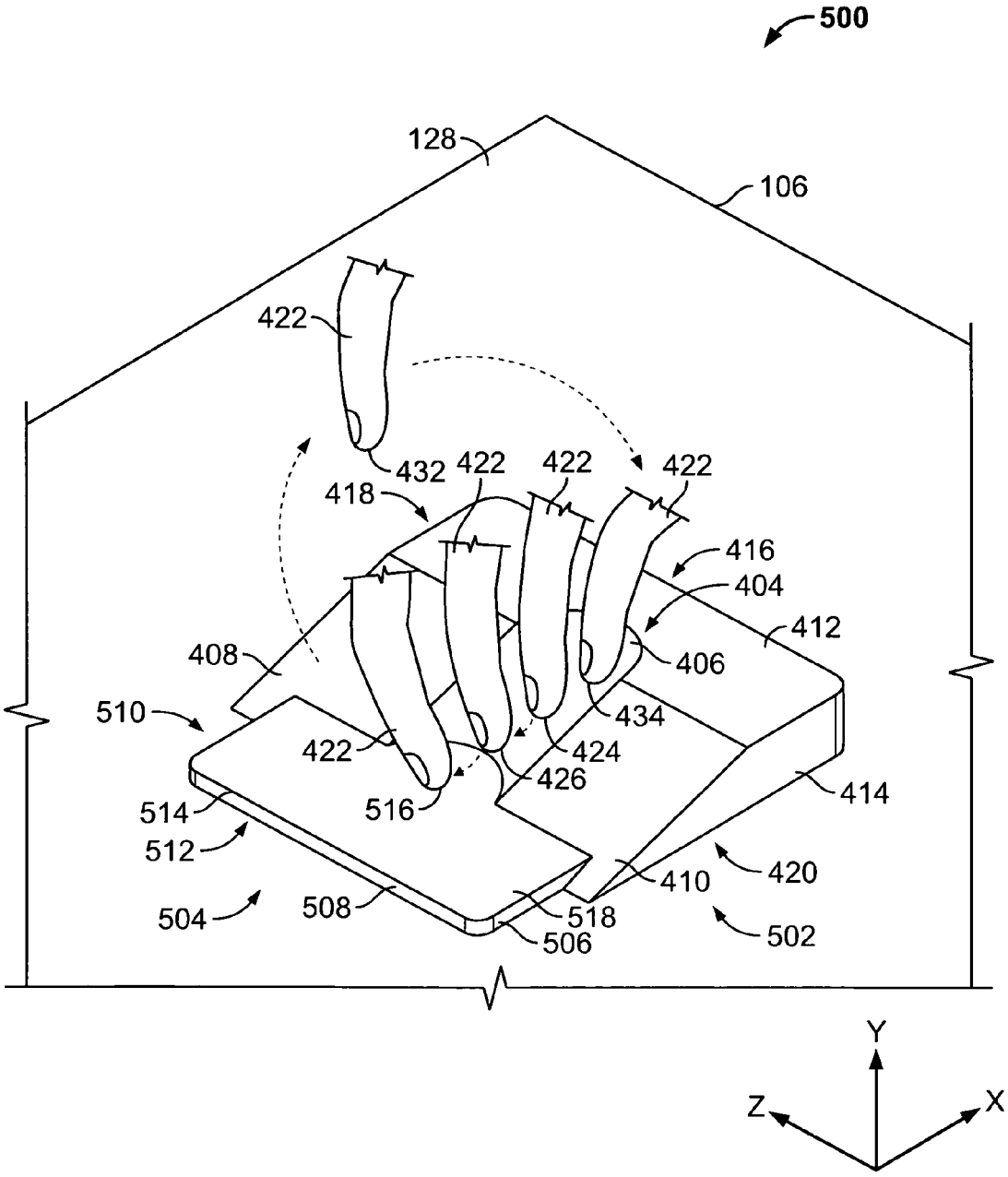
FIG. 5 is a perspective view of yet another alternate system for dealing a video card.

FIG. 5 is an embodiment of an isometric view of an embodiment of a system 500 for dealing a video card. System 500 includes display screen 106 and a dealing shoe 502. Dealing shoe 502 is an example of physical device 104 (shown in FIGS. 2 and 3). Dealing shoe 502 similar to dealing shoe 402 (shown in FIG. 4) except that dealing shoe 502 includes an extension 504. Extension 504 is fabricated from a material, such as plastic, that is translucent or transparent to light incident on the extension. For example, extension 504 is made of an acrylic that is transparent or translucent to light incident on the extension. Extension 504 forms an angle of zero degrees with respect to top surface 128. Extension 504 includes a plurality of extension side surfaces 506, 508, and 510, and an extension bottom surface 512. Extension 504 has an extension edge 514, which is an example of end 264 (shown in FIG. 2). Cross-sections of extension 504 in the yz, xy, and xz planes are polygonal.

The dealer moves finger 422 across fingerslot 404 on fingerslot surface 406 from position 426 to a position 516 on an extension top surface 518. When finger 422 is at position 516, finger 422 is in contact with extension top surface 518. Position 516 is an example of object position 252 (shown in FIG. 2). The dealer further moves finger 422 from position 516 to position 432.

In another embodiment, extension 504 is obliquely oriented, such as at an angle ranging between 180 and 200 degrees, with respect to top surface 128. In yet another embodiment, at least one of cross-sections of extension 504 in the yz, xy, and xz planes is curved. For example, a cross-section of extension 504 in the yz plane is polygonal and a cross-section of extension 504 in the xz plane is curved, and a cross-section of extension 504 in the xy plane is polygonal.

Figure 6:
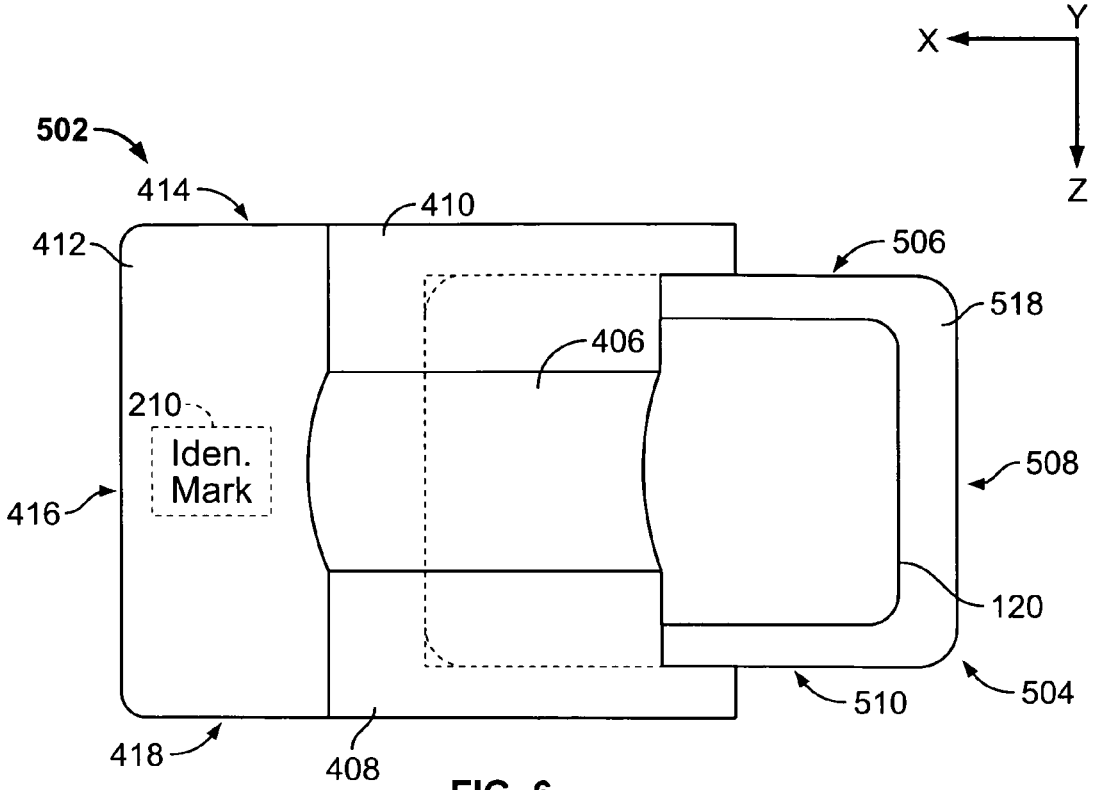
FIG. 6 is a top view of a dealing shoe used with the system shown in FIG. 5.

FIG. 6 is a top view of an embodiment of dealing shoe 502. Dealing shoe 402 (shown in FIG. 4) has a similar top view as that of dealing shoe 502 that top view of dealing shoe 402 does not include extension 504, but rather includes portions of angled surfaces 408 and 410 and fingerslot surface 406 that are obstructed by extension 504 in dealing shoe 502. Extension 504 extends outward from dealing shoe 402. A portion of stack 120 of video cards is visible via extension 504. Identification indicia 210 (shown in FIG. 2) is attached to dealing shoe lower surface 420.

Figure 7:
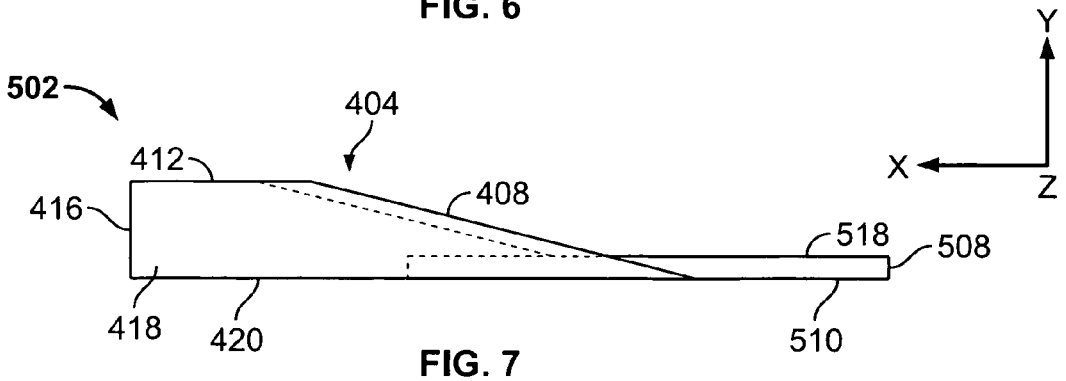
FIG. 7 is a side view of the dealing shoe shown in FIG. 6.

FIG. 7 is a side view of an embodiment of dealing shoe 502. Dealing shoe 402 (shown in FIG. 4) has a similar side view as that of dealing shoe 502 except that the side view of dealing shoe 402 excludes extension 504 and includes portions of angled surfaces 408 and 410 and fingerslot 404 that are obstructed by extension 504 in dealing shoe 502. Fingerslot 404 includes a space that extends between a plane of angled surfaces 408 and 410 and fingerslot surface 406.

Figure 8:
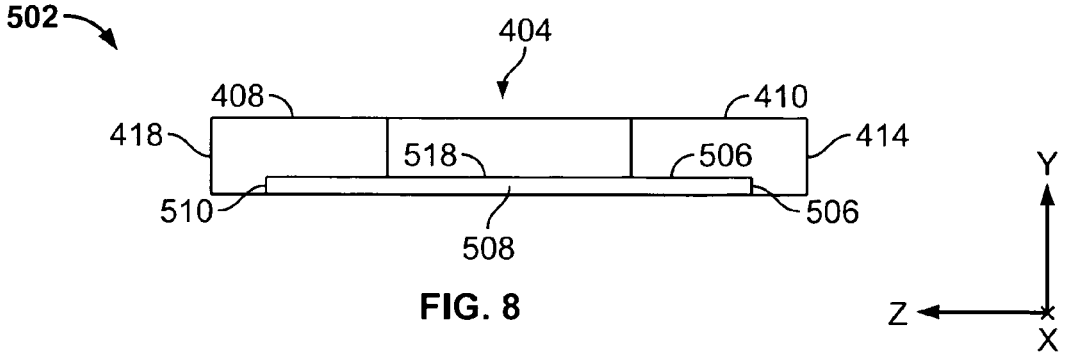
FIG. 8 is a front view of the dealing shoe of FIG. 5.

FIG. 8 is a front view of an embodiment of dealing shoe 502. A front view of dealing shoe 402 (shown in FIG. 4) is similar to the front view of dealing shoe 502 except that the front view of dealing shoe 402 excludes extension 504 and includes portions of angled surfaces 408 and 410 and fingerslot surface 406 occupied by extension 504.

Dealing shoe 502 is made by placing a material, such as plastic or a combination of plastic and metal, with a molding machine that has the same shape as that of the dealing shoe, and by heating and cooling the material.

In another embodiment, any portion of dealing shoe 502 is made by placing a material, such as plastic or a combination of plastic and metal, into a mold that is of the same size as the portion, by heating and cooling the material, and by attaching, such as gluing or welding, the portion with remaining portions of dealing shoe 502. For example, extension 504 is made by placing a clear acrylic material in a molding machine and by heating and cooling the acrylic material. A slot is made within dealing shoe 402 (shown in FIG. 4) and a portion of extension 504 is attached within slot to make dealing shoe 502.

Figure 9:
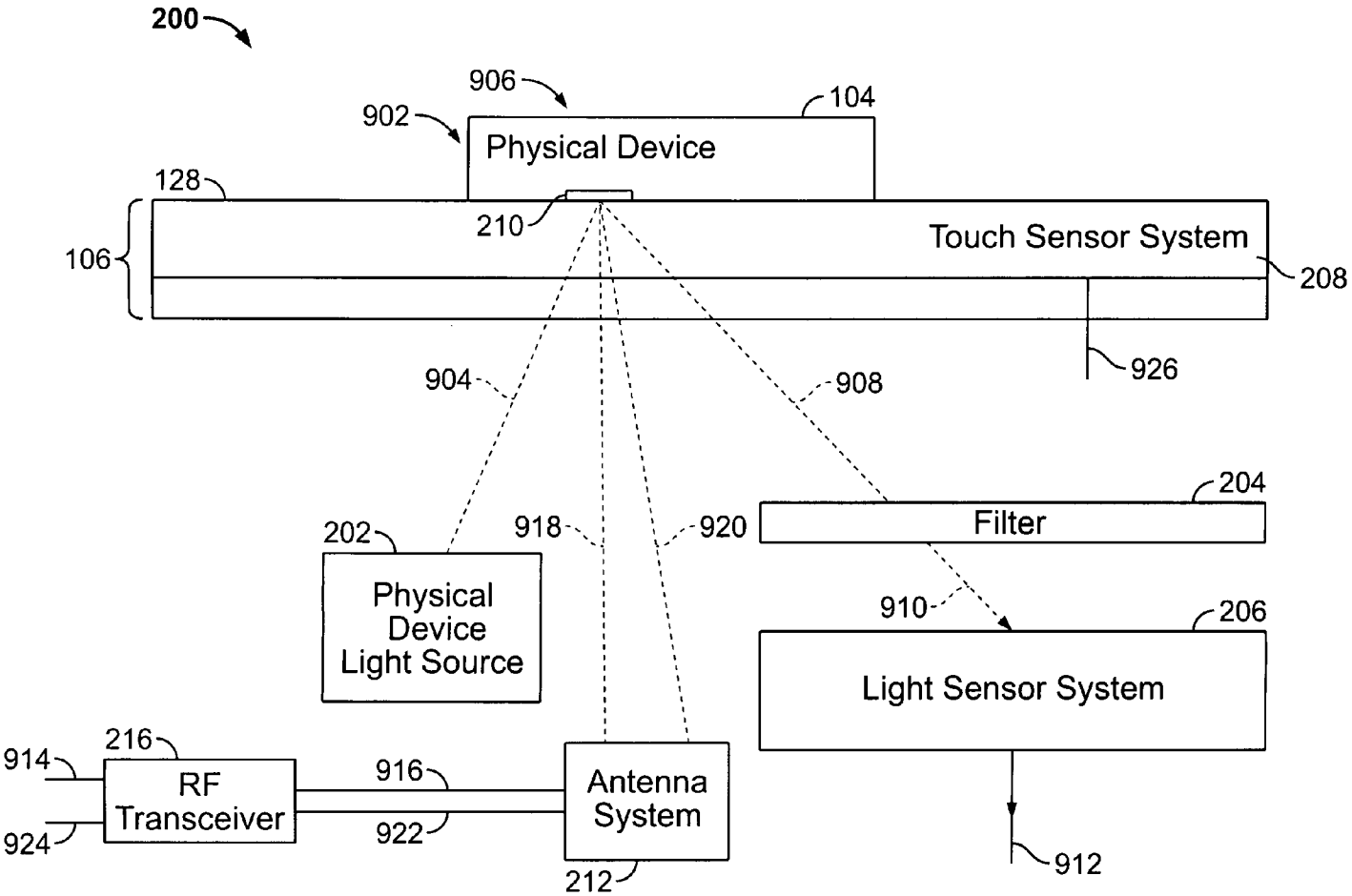
FIG. 9 is a block diagram of another alternate embodiment of the system of FIG. 2.

FIG. 9 is a block diagram of yet another embodiment of system 200 for dealing a video card. System 200 includes physical device 104 at a physical device position 902 with reference to the origin that is different than position 218 (shown in FIGS. 2 and 3) with reference to the origin. The dealer moves physical device 104 from position 218 (shown in FIG. 2) on top surface 128 to physical device position 902. The dealer moves physical device 104 from position 218 to physical device position 902 in at least one of the x, y, and z directions. In both physical device positions 218 (shown in FIG. 2) and 902, bottom surface 132 (shown in FIG. 1) is in contact with top surface 128.

When physical device 104 is at physical device position 902, light source 202 generates and emits a light 904 that is incident on at least a portion of physical device 104 and/or on identification indicia 210. When physical device 104 is at position 218, physical device 104 has an orientation 906. At least a portion of physical device 104 and/or identification indicia reflects light 904 towards filter 204 to output a reflected light 908. Filter 204 receives reflected light 908 from identification mark 210 and/or at least a portion of physical device 104 via display screen 106 and filters the light to output a filtered light 910. Light sensor system 206. senses, such as detects, filtered light 910 output from filter 204 and converts the light into a physical-device-light-sensor-output signal 912.

When physical device 104 is at physical device position 902, the RF transmitter of RF transceiver 216 receives an RF-transmitter-input signal 914 and modulates the RF-transmitter-input signal into an RF-transmitter-output signal 916, which is an RF signal. Antenna system 212 receives RF-transmitter-output signal 916 from the RF transmitter, converts the RF-transmitter-output signal into a wireless RF signal and outputs the wireless RF signal as a wireless output signal 918. Identification indicia 210 receives antenna system output signal 918 and responds to the signal with an output signal 920, which is an RF signal. Antenna system 212 receives output signal 920 from identification indicia 210 and converts the signal into a wired RF signal that is output as a wired output signal 922 to the RF receiver of RF transceiver 216. The RF receiver receives wired output signal 922 and demodulates the signal to output a set 924 of RF-receiver-output signals. Moreover, when physical device 104 is at physical device position 902, touch sensor system 208 senses the position 902 and orientation 906 to output a touch sensor output signal 926 representing the position and orientation. In another embodiment, when physical device 104 is at physical device position 902, physical device 104 has the same orientation 222 (shown in FIGS. 2 and 3) as that at position 218 (shown in FIGS. 2 and 3).

Figure 10:
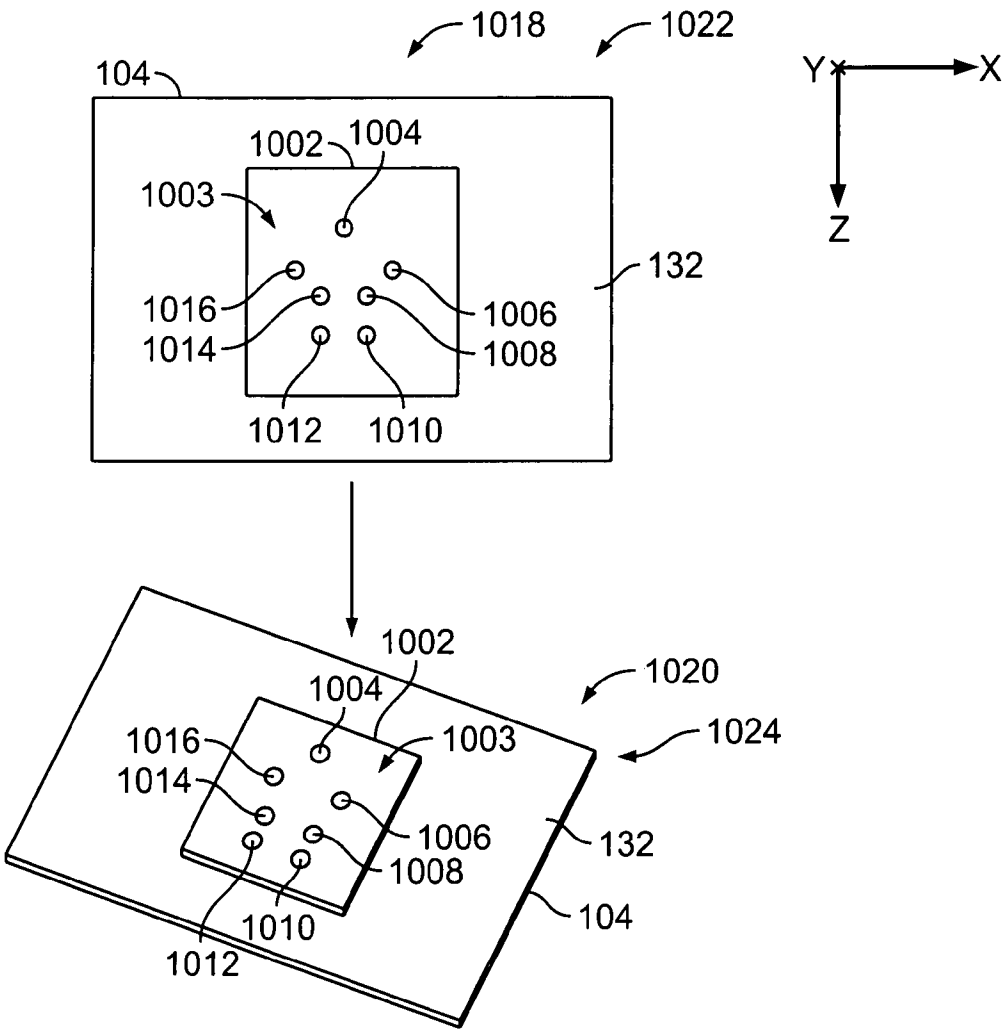
FIG. 10 is a bottom view of an exemplary physical device for use with the system of FIG. 1.

FIG. 10 is a bottom view of an embodiment of physical device 104. An RFID code label 1002 is attached, such as glued, to bottom surface 132. RFID code label 1002 embeds an RFID code 1003, which is a set of dots 1004, 1006, 1008, 1010, 1012, 1014, and 1016 that represent a unique value assigned to physical device 104. RFID code 1003 is an example of identification indicia 210 (shown in FIGS. 2, 3, and 9).

The dealer moves, such as displaces, physical device 104 from an RFID code position 1018 to an RFID code position 1020. RFID code position 1018 is an example of position 218 (shown in FIGS. 2 and 3) and RFID code position 1020 is an example of physical device position 902 (shown in FIG. 9). When physical device 104 is at RFID code position 1018, RFID code 1003 has an RFID code orientation 1022 with respect to the origin and when physical device 104 is at RFID code position 1020, RFID code has an RFID code orientation 1024 with respect to the origin. RFID code orientation 1022 is an example of orientation 222 (shown in FIGS. 2 and 3) and RFID code orientation 1024 is an example of orientation 906 (shown in FIG. 9).

Moreover, when physical device 104 is at RFID code position 1018, dots 1004, 1006, 1008, 1010, 1012, 1014, and 1016 are at different dot positions with respect to the origin than dot positions of the dots attached to physical device 104 at RFID code position 1020. For example, when physical device 104 is at RFID code position 1018, dot 1004 is at a different dot position with respect to the origin than the dot position of dot 1004 attached to physical device 104 at RFID code position 1020. Further, when physical device 104 is at RFID code position 1018, dots 1004, 1006, 1008, 1010, 1012, 1014, and 1016 have different dot orientations with respect to the origin than dot orientations of the dots attached to physical device 104 at RFID code orientation 1024. For example, when physical device 104 is at RFID code 1018, dot 1004 has a different dot orientation than the dot orientation of dot 1004 attached to physical device 104 at RFID code orientation 1024. All positions and orientations are measured with respect to the origin.

In another embodiment, an RFID code includes any number of dots, such as a number of dots that can be used to represent 256 values or a number of dots used to represent 512 values. In yet another embodiment, a radial code or a matrix code is used instead of RFID code 1023.

Figure 11:
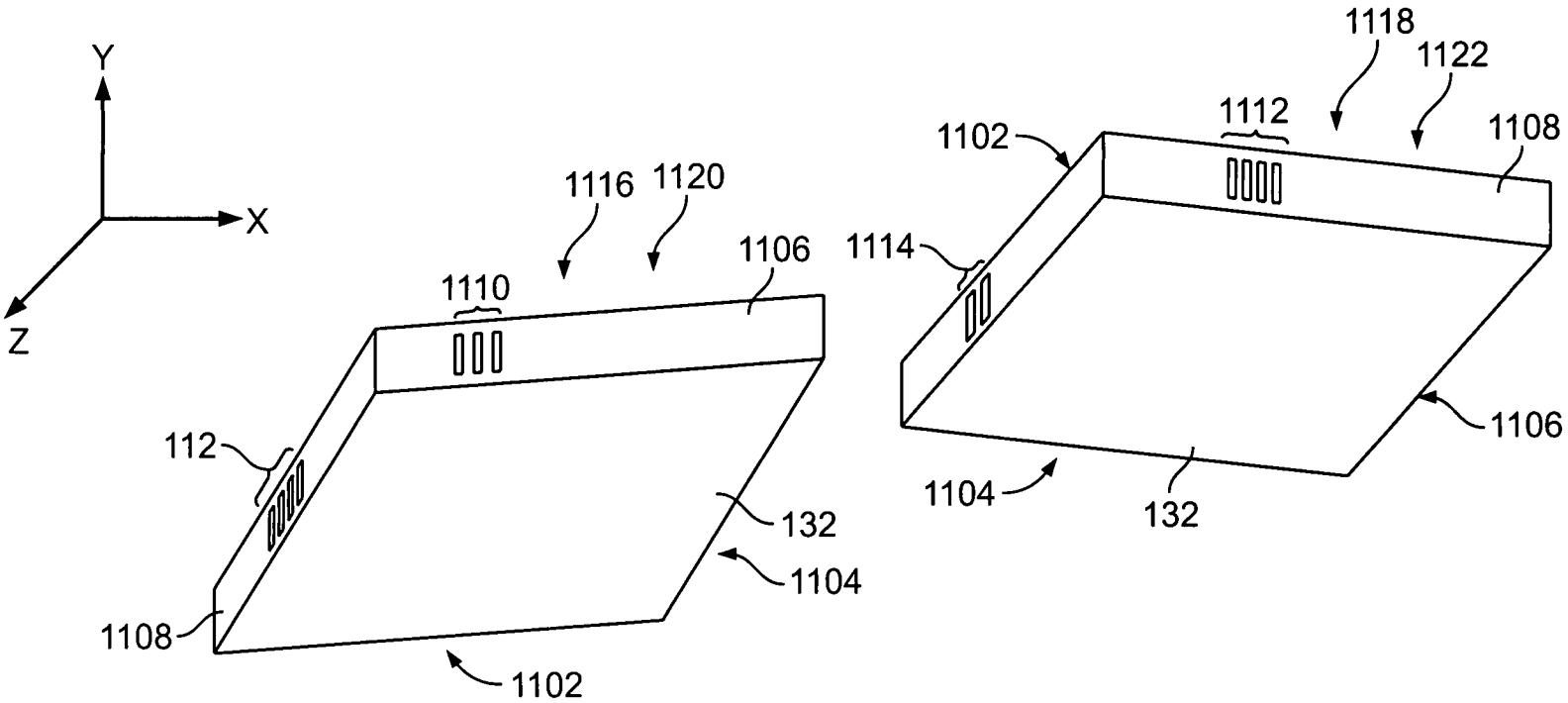
FIG. 11 is an isometric view of an exemplary physical device that may be used with the system shown in FIG. 1.

FIG. 11 is an isometric view of an embodiment of physical device 104 (shown in FIGS. 2, 3, and 9). Physical device 104 includes a plurality of physical device side surfaces 1102, 1104, 1106, and 1108, and bottom surface 132. A barcode 1110 is attached to physical device side surface 1108 and a barcode 1112 is attached to physical device side surface 1106. Moreover, a barcode 1114 is attached to physical device side surface 1102.

The dealer moves physical device 104 from a barcode position 1116 to a barcode position 1118. Barcode position 1116 is an example of position 218 (shown in FIGS. 2 and 3) and barcode position 1118 is an example of physical device position 902 (shown in FIG. 9). When physical device 104 is at barcode position 1116, barcodes 1110 and 1112 represent a barcode orientation 1120 of physical device 104 with respect to the origin and when physical device 104 is at barcode position 1118, barcodes 1112 and 1114 represent a barcode orientation 1122 of physical device 104 with respect to the origin. Barcode orientation 1120 is an example of orientation 222 (shown in FIGS. 2 and 3) and barcode orientation 1122 is an example of orientation 906 (shown in FIG. 9).

In another embodiment, physical device 104 has a different number of physical device side surfaces than four. In yet another embodiment, any of barcodes 1110, 1112, and 1114 includes any number of stripes. In still another embodiment, each barcode 1110, 1112, and 1114 has the same number of stripes, and at least one stripe of barcode 1110 is different in size than a size of at least one stripe of barcode 1112 and a size of at least one stripe of barcode 1114. In such an embodiment, at least one stripe of barcode 1112 is different in size than a size of at least one stripe of barcode 1114. In still another embodiment, radial codes are attached to physical device side surfaces 1102, 1104, 1106, and 1108 instead of barcodes 1110, 1112, and 1114. In yet another embodiment, matrix codes are attached to physical device side surfaces 1102, 1104, 1106, and 1108 instead of barcodes 1110, 1112, and 1114. In another embodiment, a combination of radial codes, matrix codes, and barcodes is attached to any of physical device side surfaces 1102, 1104, 1106, and 1108. In still another embodiment, a barcode is attached to physical device side surface 1104.

Figure 12:
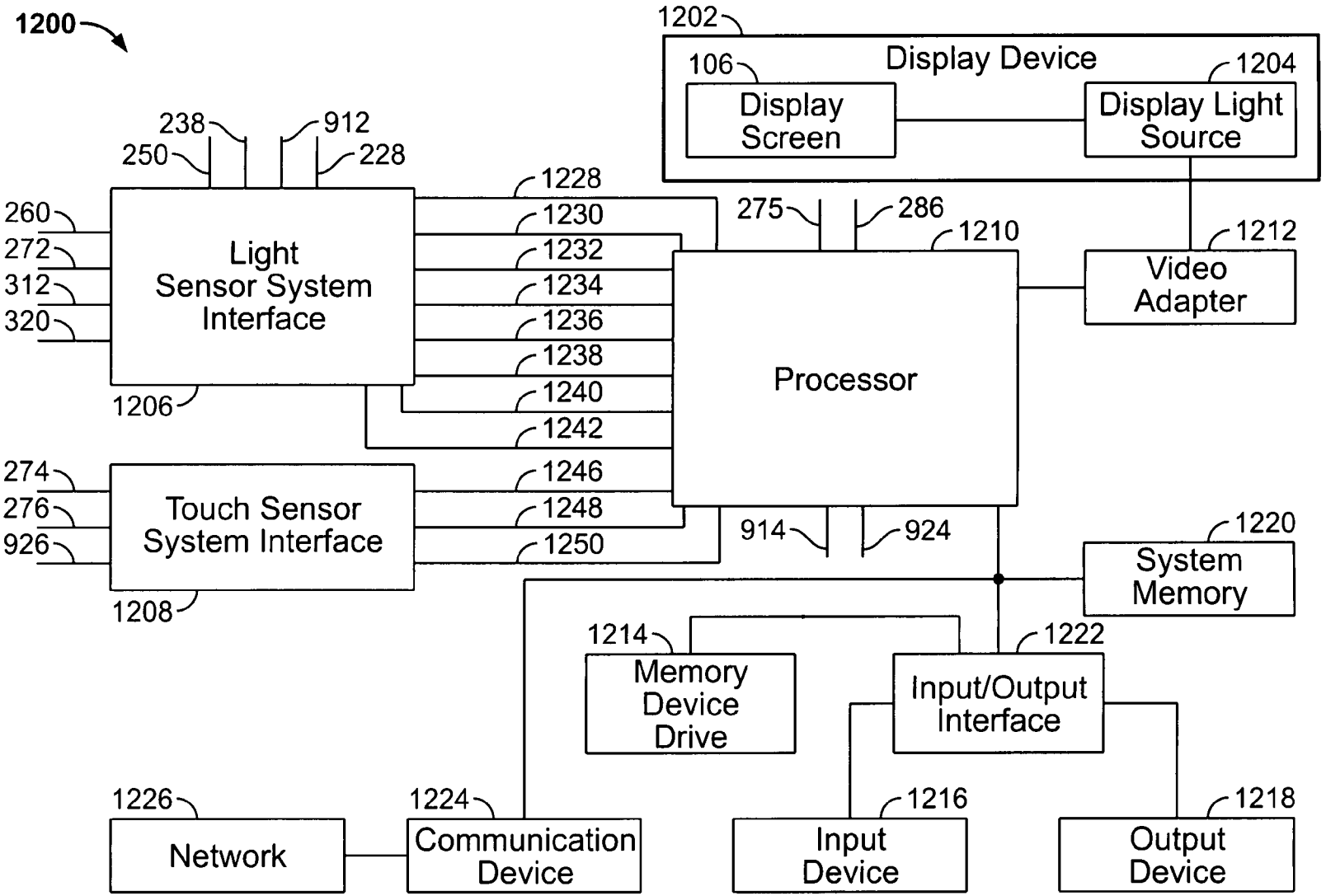
FIG. 12 is a block diagram of another embodiment of a system for dealing a video card.

FIG. 12 is a block diagram of an embodiment of a system 1200 for dealing a video card. System 1200 includes a display device 1202, which further includes a display light source 1204 and display screen 106. System 1200 further includes a light sensor system interface 1206, a touch sensor system interface 1208, a processor 1210, a video adapter 1212, a memory device drive 1214, an input device 1216, an output device 1218, a system memory 1220, an input/output interface 1222, a communication device 1224, and a network 1226.

As used herein, the term processor is not limited to just those integrated circuits referred to in the art as a processor, but broadly refers to a microcontroller, a microcomputer, a programmable logic controller, an application specific integrated circuit, and any other programmable circuit. Video adapter 1212 is a video graphics array. System memory 1220 includes a random access memory (RAM) and a read-only memory (ROM). System memory 1220 includes a basic input/output (BIOS) system, which is a routine that enables transfer of information between processor 1210, video adapter 1212, input/output interface 1222, memory device drive 1214, and communication device 1224 during start up of the processor. System memory 1220 further includes an operating system, an application program, such as a video card game, a word processor program, or a graphics program, and other data.

Input device 1216 may be a game pedal, a mouse, a joystick, a keyboard, a scanner, or a stylus. Examples of output device 1218 include a display device, such as a cathode ray tube (CRT) display device, an LCD device, and a plasma display device. Input/output interface 1222 may be a serial port, a parallel port, a video adapter, or a universal serial bus (USB). Communication device 1224 may be a modem or a network interface card (NIC) that allows processor 1210 to communicate with network 1226. Examples of network 1226 include a wide area network (WAN), such as the Internet, or a local area network (LAN), such as an Intranet.

Memory device drive 1214 may be a magnetic disk drive or an optical disk drive. Memory device drive 1214 includes a memory device, such as an optical disk, which may be a compact disc (CD) or a digital video disc (DVD). Other examples of the memory device include a magnetic disk. The application program may be stored in the memory device. Each of the memory device and system memory 1220 is a computer-readable medium that is readable by processor 1210.

Display device 1202 may be a plasma display device, a CRT display device, an LCD device, or a projector system including a projector. Examples of display light source 1204 includes a set of light emitting diodes, an incandescent light bulb, and an incandescent light tube. Display screen 106 may be a projector screen, a plasma screen, an LCD screen, an acrylic screen, or a cloth screen.

Light sensor system interface 1206 includes a digital camera interface, a filter, an amplifier, and/or an analog-to-digital (AID) converter. Touch screen system interface 1208 includes a comparator having a comparator input terminal that is connected to a threshold voltage. Touch sensor system interface 1208 may include a filter, an amplifier, and/or an A/D converter.

Light sensor system interface 1206 receives physical-device-light-sensor-output signal 228 (shown in FIG. 2) from light sensor system 206, may amplify the signal, may filter the signal, and may convert the signal from an analog format to a digital format to output a physical-device-light-sensor-interface-output signal 1228. Light sensor system interface 1206 performs a similar operation on physical-device-light-sensor-output signal 912 (shown in FIG. 9) as that performed on physical-device-light-sensor-output signal 228. For example, light sensor system interface 1206 receives physical-device-light-sensor-output signal 912 from light sensor system 206, may amplify the signal, may filter the signal, and may convert the signal from an analog format to a digital format to output a physical-device-light-sensor-interface-output signal 1230.

Light sensor system interface 1206 receives object-light-sensor-output signal 238 from light sensor system 206, may amplify the signal, may filter the signal, and may convert the signal from an analog format to a digital format to output an object-light-sensor-interface-output signal 1232. Light sensor system interface 1206 performs a similar operation on object-light-sensor-output signal 250 as that performed on object-light-sensor-interface-output signal 238. For example, light sensor system interface 1206 receives object-light-sensor-output signal 250 from light sensor system 206, may amplify the signal, may filter the signal, and may convert the signal from an analog format to a digital format to output an object-light-sensor-interface-output signal 1234. Light sensor system interface 1206 performs a similar operation on object-light-sensor-output signal 260 as that performed on object-light-sensor-interface-output signal 250 to output an object-light-sensor-interface-output signal 1236. Light sensor system interface 1206 performs a similar operation on object-light-sensor-output signal 272 as that performed on object-light-sensor-interface-output signal 260 to output an object-light-sensor-interface-output signal 1238. Light sensor system interface 1206 performs a similar operation on object-light-sensor-output signal 312 (shown in FIG. 3) as that performed on object-light-sensor-interface-output signal 272 to output an object-light-sensor-interface-output signal 1240. Light sensor system interface 1206 performs a similar operation on object-light-sensor-output signal 320 as that performed on object-light-sensor-interface-output signal 312 to output an object-light-sensor-interface-output signal 1242.

Moreover, touch sensor system interface 1208 receives object-touch-sensor-output signal 274 (shown in FIG. 2) from touch sensor system 208, may amplify the signal, may filter the signal, may convert the signal from an analog to a digital format, and compares a voltage of the signal with the threshold voltage to output an object-touch-sensor-interface-output signal 1246. Upon determining that a voltage of object-touch-sensor-output signal 274 is greater than the threshold voltage, the comparator outputs object-touch-sensor-interface-output signal 1246 representing that the voltage of the object-touch-sensor-output signal 274 is greater than the threshold voltage. On the other hand, upon determining that a voltage of object-touch-sensor-output signal 274 is equal to or less than the threshold voltage, the comparator outputs object-touch-sensor-interface-output signal 1246 representing that the voltage of the object-touch-sensor-output signal 274 is less than or equal to the threshold voltage.

Touch sensor system interface 1208 receives physical-device-touch-sensor-output signal 276 from touch sensor system 208 and performs a similar operation on the signal as that performed on object-touch-sensor-output signal 274 to output a physical-device-touch-sensor-interface-output signal 1248. For example, touch sensor system interface 1208 receives physical-device-touch-sensor-output signal 276 from touch sensor system 208, may amplify the signal, may filter the signal, may convert the signal from an analog to a digital format, and compares a voltage of the signal with the threshold voltage to output physical-device-touch-sensor-interface-output signal 1248. Upon determining that a voltage of physical-device-touch-sensor-output signal 276 is greater than the threshold voltage, the comparator outputs physical-device-touch-sensor-interface-output signal 1248 representing that the voltage of the physical-device-touch-sensor-output signal 276 is greater than the threshold voltage. On the other hand, upon determining that a voltage of physical-device-touch-sensor-output signal 276 is equal to or less than the threshold voltage, the comparator outputs physical-device-touch-sensor-interface-output signal 1248 representing that the voltage of the physical-device-touch-sensor-output signal 276 is less than or equal to the threshold voltage. Moreover, touch sensor system interface 1208 receives physical-device-touch-sensor-output signal 926 (shown in FIG. 9) from touch sensor system 208 and performs a similar operation on the signal as that performed on physical-device-touch-sensor-output signal 276 to output a physical-device-touch-sensor-interface-output signal 1250.

Processor 1210 instructs the RF transmitter of RF transceiver 216 to transmit RF-transmitter-output signal 278 (shown in FIG. 2) by sending RF-transmitter-input signal 275 to the transmitter. Moreover, processor 1210 instructs the RF transmitter of RF transceiver 216 to transmit RF-transmitter-output signal 916 (shown in FIG. 9) by sending RF-transmitter-input signal 914 to the transmitter.

In another embodiment, system 1200 does not include output device 1218, network 1226, and communication device 1224. In yet another embodiment, system 1200 does not include touch sensor system interface 1208. In still another embodiment, system 1200 does not include light sensor system interface 1206 and directly receives a signal, such as physical-device-light-sensor-output signal 228 or object-light-sensor-output signal 238, from light sensor system 206.

Processor 1210 receives physical-device-light-sensor-interface-output signal 1228 from light sensor system interface 1206 and determines an identification indicia value of identification indicia 210 (shown in FIG. 2) from the signal. Upon determining an identification indicia value of identification indicia 210 from physical-device-light-sensor-interface-output signal 1228, processor 1210 determines whether the value matches a stored identification indicia value of the mark. A user stores an identification indicia value within the memory or within system memory 1220. Upon determining that an identification indicia value of identification indicia 210 represented by physical-device-light-sensor-interface-output signal 1228 matches the stored identification indicia value, processor 1210 determines that physical device 104 is valid and belongs within the facility. On the other hand, upon determining that an identification indicia value of identification indicia 210 represented by physical-device-light-sensor-interface-output signal 1228 does not match the stored identification indicia value, processor 1210 determines that physical device 104 is invalid and does not belong within the facility.

Moreover, processor 1210 also obtains a table identification value uniquely identifying gaming table 102 (shown in FIG. 1) having display screen 106 and determines whether the table identification value is the same as a stored table identification value. The stored table identification value corresponds to the stored identification indicia value. Processor 1210 obtains a table identification value in a similar manner as that of obtaining an identification indicia value from physical-device-light-sensor-interface-output signal 1228. For example, processor 1210 obtains, via a barcode scanner, a signal that represents a barcode identifying gaming table 102 including display screen 106.

Upon determining that a table identification value obtained is the same as that of the stored table identification value, processor 1210 determines that physical device 104 is placed on a valid gaming table 102 and belongs on the table. On the other hand, upon determining that a table identification value obtained is not the same as that of the stored table identification value, processor 1210 determines that physical device 104 is placed on an invalid gaming table 102 and does not belong on top surface 128.

Moreover, processor 1210 receives physical-device-light-sensor-interface-output signal 1228 and determines position 218 and orientation 222 (shown in FIG. 2) of physical device 104 from the signal. For example, processor 1210 generates an image of display screen 106 and physical device 104 from physical-device-light-sensor-interface-output signal 1228, and determines a distance, parallel to either the x, y, or z axis, from the origin of pixels representing the physical device 104 within the image. As another example, processor 1210 generates an image of display screen 106 and physical device 104 from physical-device-light-sensor-interface-output signal 1228, and determines, with respect to the xyz co-ordinate system, a co-ordinate of a vertex pixel representing a vertex of physical device 104 in the image and the co-ordinates represent orientation 222 (shown in FIG. 2). A number of co-ordinates of vertices of physical device 104 within the xyz co-ordinate system represents a shape of physical device 104. For example, if physical device 104 is a cube, physical device 104 has eight vertices and if physical device 104 is a pyramid, physical device 104 has four vertices. Each vertex has co-ordinate with respect to the origin. As another example, processor 1210 determines, from physical-device-light-sensor-interface-output signal 1228, barcode values of barcodes 1110 and 1112 (shown in FIG. 11) and determines that physical device 104 has barcode position 1116 (shown in FIG. 11) with respect to the origin and barcode orientation 1120 (shown in FIG. 11) with respect to the origin. Processor 1210 receives physical-device-light-sensor-interface-output signal 1230 (shown in FIG. 12) and determines physical device position 902 and orientation 906 (shown in FIG. 9) of physical device 104 from the signal in a manner similar to determining position 218 (shown in FIG. 2) and orientation 222 (shown in FIG. 2) from physical-device-light-sensor-interface-output signal 1228. Processor 1210 establishes any position and any orientation with reference to the origin.

Processor 1210 receives set 286 of RF-receiver-output signals and determines position 218 and orientation 222 (shown in FIG. 2) of physical device 104 from the set. As an example, processor 1210 determines a plurality of amplitudes of x, y, and z signals of set 286 of RF-receiver-output signals (shown in FIG. 2) and determines a dot position and a dot orientation of dot 1004 (shown in FIG. 10) from the amplitudes. The x signal of set 286 is generated from a signal received by the x-antenna, the y signal of set 286 is generated from a signal received by the y-antenna, and the z signal of set 286 is generated from a signal received by the z-antenna. In this example, processor 1210 may determine an amplitude of the x signal of set 286 when amplitudes of the y and z signals within set 286 are zero and the amplitude of the x signal represents RFID code position 1018 (shown in FIG. 10) along the x axis with respect to the origin. In this example, processor 1210 may determine amplitudes of the y and z signals within set 286 when an amplitude of the x signal is zero, may determine amplitudes of the x and z signals within set 286 when an amplitude of the y signal within set 286 is zero, may determine amplitudes of the x and z signals within set 286 when an amplitude of the y signal is zero, and may determine RFID code orientation 1022 (shown in FIG. 10) as a function of the determined amplitudes. The function may include an inverse tangent of a ratio of amplitudes of y and z signals within set 286 when an amplitude of the x signal within set 286 is zero, an inverse tangent of a ratio of amplitudes of x and z signals within set 286 when an amplitude of the y signal within set 286 is zero, and an inverse tangent of a ratio of amplitudes of x and y signals within set 286 when an amplitude of the z signal within set 286 is zero. Processor 1210 receives set 924 (shown in FIG. 9) of RF-receiver-output signals and determines physical device position 902 and orientation 906 (shown in FIG. 9) of physical device 104 from the set 924 in a manner similar to that of determining position 218 and orientation 222 (shown in FIG. 2) from set 286.

Processor 1210 receives physical-device-touch-sensor-interface-output signal 1248 and determines co-ordinates, with respect to the origin, of a plurality of touch sensors of the touch sensor system 208 that output physical-device-touch-sensor-output signal 276 to determine position 218 and orientation 222 (shown in FIG. 2). Processor 1210 also receives physical-device-touch-sensor-interface-output signal 1250 and determines co-ordinates, with respect to the origin, of a plurality of touch sensors of the touch sensor system 208 that output physical-device-touch-sensor-output signal 926 to determine physical device position 902 and orientation 906 (shown in FIG. 9). Further, processor 1210 receives object-touch-sensor-interface-output signal 1246 and determines object position 262 (shown in FIG. 2) of object 214 from the signal.

Processor 1210 determines a position and an orientation of object 214 and/or physical device 104 from positions and orientations of a plurality of sensors that output a touch-sensor-output signal. For example, upon determining that a plurality of touch sensors at a distance, parallel to one of the x, y, and z axes, output an object-touch-sensor-output signal, processor 1210 determines that object 214 has a position represented by the distance from the origin. As another example, upon determining that a plurality of touch sensors at a distance, parallel to one of the x, y, and z axes, output a physical-device-touch-sensor-output signal, processor 1210 determines that physical device 104 has a position represented by the distance from the origin. As another example, upon determining that a plurality of touch sensors at a set of co-ordinates output a physical-device-touch-sensor-output signal, processor 1210 determines that physical device 104 has an orientation represented by the co-ordinates.

Moreover, processor 1210 receives object-light-sensor-interface-output signal 1232 from light sensor system interface 1206 and determines object position 230 of object 214 from the signal. For example, processor 1210 generates an image of display screen 106 and object 214 from object-light-sensor-interface-output signal 1232, and determines a distance, parallel to either the x, y, or z axis, from the origin of pixels representing the object 214 within the image. As another example, processor 1210 generates an image of display screen 106 and object 214 from object-light-sensor-interface-output signal 1232, and determines, with respect to the xyz co-ordinate system, a co-ordinate of a vertex pixel representing a vertex of object 214 in the image and the co-ordinates represent object orientation 222 (shown in FIG. 2). Processor 1210 receives object-light-sensor-interface-output signal 1234 and determines object position 240 (shown in FIG. 2) of object 214 from the signal in a manner similar to determining object position 230 (shown in FIG. 2). Moreover, processor 1210 receives object-light-sensor-interface-output signal 1236 and determines object position 252 (shown in FIG. 2) of object 214 from the signal in a manner similar to determining object position 230. Further, processor 1210 receives object-light-sensor-interface-output signal 1238 and determines object position 262 (shown in FIG. 2) of object 214 from the signal in a manner similar to determining object position 230. Processor 1210 receives object-light-sensor-interface-output signal 1240 and determines object position 302 (shown in FIG. 3) of object 214 from the signal in a manner similar to determining object position 230. Further, processor 1210 receives object-light-sensor-interface-output signal 1242 and determines object position 304 (shown in FIG. 3) of object 214 from the signal in a manner similar to determining object position 230.

Processor 1210 determines a change between physical device position 902 (shown in FIG. 9) and position 218 (shown in FIG. 2). For example, processor 1210 subtracts a distance, parallel to the x axis, of position 218 (shown in FIG. 9) from a distance, parallel to the x axis, of physical device position 902 (shown in FIG. 2) to determine a change between the physical device positions 902 and 218. As another example, processor 1210 subtracts a distance, parallel to the y axis, of position 218 (shown in FIG. 9) from a distance, parallel to the y axis, of physical device position 902 (shown in FIG. 2) to determine a change between the physical device positions 902 and 218.

Moreover, processor 1210 determines a change between orientation 906 (shown in FIG. 9) and orientation 222 (shown in FIG. 2). For example, processor 1210 determines a change between orientation 906 (shown in FIG. 9) and orientation 222 (shown in FIG. 2) by subtracting co-ordinates of a vertex of physical device 104 at orientation 222 (shown in FIG. 2) from co-ordinates of a vertex of physical device 104 at orientation 906 (shown in FIG. 9) to determine a change between the orientations 906 and 222.

Processor 1210 determines a plurality of stack positions of stack 120 with respect to the origin based on physical device positions 218 and 902 (shown in FIGS. 2 and 9), and determines changes in the stack positions based on changes in the physical device positions 218 and 902. For example, upon determining that physical device 104 is at position 218 (shown in FIG. 2) with respect to the origin, processor 1210 instructs video adapter 1212 to control display light source 1204 and display screen 106 to display stack 120 at position 218 on display screen 106. As another example, upon determining that physical device 104 is at physical device position 902 (shown in FIG. 9) with respect to the origin, processor 1210 instructs video adapter 1212 to control display light source 1204 and display screen 106 to display stack 120 at physical device position 902 on display screen 106. As yet another example, upon determining that physical device 104 is at position 218 (shown in FIG. 2) with respect to the origin, processor 1210 instructs video adapter 1212 to control display light source 1204 and display screen 106 to display stack 120 at an increment or a decrement of the position 218. As still another example, upon determining that physical device 104 is at physical device position 902 (shown in FIG. 9) with respect to the origin, processor 1210 instructs video adapter 1212 to control display light source 1204 and display screen 106 to display stack 120 at a position increment or a position decrement of the physical device position 902.

The user provides the position increment and decrement to processor 1210 via input device 1216. The position increment and the position decrement are measured along the same axis as physical device positions 218 and 902 (shown in FIGS. 2 and 9). For example, if position 218 (shown in FIG. 2) is measured parallel to the y axis, the physical device position in incremented by the position increment parallel to the y axis. As another example, if physical device position 902 (shown in FIG. 9) is measured parallel to the x axis, the physical device position in incremented by the position increment parallel to the x axis.

Processor 1210 determines a plurality of stack orientations of stack 120 with respect to the origin based on orientations 222 and 906 (shown in FIGS. 2 and 9), and determines changes in the stack orientations based on changes in the orientations. For example, upon determining that physical device 104 is at orientation 222 (shown in FIG. 2) with respect to the origin, processor 1210 instructs video adapter 1212 to control display light source 1204 and display screen 106 to display stack 120 at orientation 222 on display screen 106. As another example, upon determining that physical device 104 is at orientation 906 (shown in FIG. 9) with respect to the origin, processor 1210 instructs video adapter 1212 to control display light source 1204 and display screen 106 to display stack 120 at orientation 906 on display screen 106. As yet another example, upon determining that physical device 104 is at orientation 222 (shown in FIG. 2) with respect to the origin, processor 1210 instructs video adapter 1212 to control display light source 1204 and display screen 106 to display stack 120 at an increment or a decrement of the orientation 222. As still another example, upon determining that physical device 104 is at orientation 906 (shown in FIG. 9) with respect to the origin, processor 1210 instructs video adapter 1212 to control display light source 1204 and display screen 106 to display stack 120 at an orientation increment or an orientation decrement of the orientation 906.

The user provides the orientation increment and orientation decrement to processor 1210 via input device 1216. The orientation increment and the orientation decrement are measured along at least one of x, y, and z axes. For example, if orientation 222 (shown in FIG. 2) is $(x_1, y_1, z_1)$, processor 1210 increments orientation 222 by the orientation increment to output a stack orientation $(x_1+1, y_1+1, z_1)$, where +1 is the orientation increment. As another example, if orientation 222 (shown in FIG. 2) is $(x_1, y_1, z_1)$, processor 1210 increments orientation 222 by the orientation decrement to output a stack orientation $(x_1-2, y_1-1, z_1)$, where −1 and −2 are the orientation decrement.

Processor 1210 receives object-light-sensor-interface-output signal 1232 representing object position 230 (shown in FIG. 2) and determines to trigger an initial deal of one of the video cards in stack 120. Processor 1210 triggers the initial deal of one of the video cards in stack 120 by instructing video adapter 1212 to control display light source 1204 and display screen 106 to display the video card as displaced, along at least one of the x, y, and z axes, by a pre-determined amount from the remainder of the stack 120. The user provides the pre-determined amount to processor 1210 via input device 1216. An example of the pre-determined amount is an amount that processor 1210 adds to a video card position of one of the video cards in stack 120 to generate a resulting card position of the video card with respect to the origin. The resulting card position lies outside player display areas 124 and 126 and outside dealer display area 122. When one of the video cards of stack 120 is at the resulting card position, processor 1210 instructs video adapter 1212 to control display light source 1204 and display screen 106 to display the video card as contacting the remaining cards in stack 120.

Processor 1210 receives object-light-sensor-interface-output signal 1234 representing object position 240 (shown in FIG. 2) and determines to continue to trigger the initial deal. Moreover, processor 1210 receives object-light-sensor-interface-output signal 1236 representing object position 252 (shown in FIG. 2) and determines to continue to trigger the initial deal. Processor 1210 determines to initially deal one of the video cards in stack 120 upon receiving object-light-sensor-interface-output signal 1238 representing object position 262 (shown in FIG. 2). The initial deal deals the same card that processor 1210 triggers to initially deal. When one of video cards in stack 120 is initially dealt, processor 1210 instructs video adapter 1212 to control display light source 1204 and display screen 106 to display the video card leaving stack 120 and reaching one of dealer display area 122, player display area 124, and player display area 126.

Processor 1210 receives object-light-sensor-interface-output signal 1240 representing object position 302 (shown in FIG. 3) and determines not to trigger an additional deal of one of the video cards in stack 120. Processor 1210 further receives object-light-sensor-interface-output signal 1242 representing object position 304 (shown in FIG. 3) and determines to trigger the additional deal of one of the video cards from stack 120. Processor 1210 triggers the additional deal of one of the video cards in stack 120 by instructing video adapter 1212 to control display light source 1204 and display screen 106 to display the video card as displaced, along one of the x, y, and z axes by the pre-determined amount from the remainder of the stack 120. The additional deal deals the next video card from stack 120 after a video card dealt by the initial deal and the additional deal is performed in a similar manner as that of performing the initially deal. For example, the additional deal is performed when object 214 contacts top surface 128 at object position 262.

Processor 1210 determines not to trigger the additional deal upon determining that object-light-sensor-interface-output signal 1242 is received within a pre-determined time window from the initial deal. For example, processor 1210 determines not to trigger the additional deal upon determining that object-light-sensor-interface-output signal 1242 and object-light-sensor-interface-output signal 1234 are received within the pre-determined time window. The user provides the pre-determined time window to processor 1210 via input device 1216.

Processor 1210 determines whether to trigger a deal or deal one of the video cards in stack 120 based on a state of a video card game. For example, upon determining that a video card game is Poker, that an ante is placed by players playing at player display areas 124 and 126, and receiving object-light-sensor-interface-output signal 1238, processor 1210 initially deals one of the video cards in stack 120 to player display area 124. As another example, upon determining a video card game is Blackjack, that player playing at player display area 124 has made a bet, that no bets are previously made by players at player display areas 124 and 126 in the Blackjack game, and receiving object-touch-sensor-interface-output signal 1246, processor 1210 initially deals one of the video cards in stack 120 to dealer display area 122. As yet another example, in a game of Blackjack, upon determining that one of the video cards from stack 120 is dealt to dealer display area 122 and to player display area 124, and that a player at the player display area is provided an amount of time to decide to hit or stand, and receiving object sensor system interface output signal 1242, processor 1210 does not additionally deal one of the video cards from stack 120. In the example, processor 1210 determines not to additionally deal a video card from stack to player display area 124 until an indication of a hit is received from a player at the player display area. In the example, the user provides the amount of time to processor 1210 via input device 1216.

Regardless, such as independent, of a state of a video card game and regardless of receiving a sensor-interface output signal that triggers a deal, processor 1210 determines not to trigger the deal from stack 120 upon determining that an object parameter, such as a diameter or length, of object 214 does not lie within a pre-defined range. As an example, processor 1210 determines the object parameter as a diameter of an area on top surface 128 occupied by object 214 within an image generated by processor 1210. As another example, processor 1210 determines the object parameter as a length of an area on top surface 128 occupied by object 214 within an image generated by processor 1210. As yet another example, upon receiving object-light-sensor-interface-output signal 1232, receiving an indication from a player at player display area 124 to hit, and determining that an object diameter of object 214 is outside the pre-defined range, processor 1210 does not trigger the initial deal. As yet another example, upon receiving object-light-sensor-interface-output signal 1242, receiving an indication from a player at player display area 124 to receive a video card from stack 120, and determining that an object length of object 214 is outside the pre-defined range, processor 1210 does not trigger the additional deal. The user provides the pre-defined range, such as a pre-defined diameter or a pre-defined length, to processor 1210 via input device 1216.

In another embodiment, when one of the video cards of stack 120 is at the resulting card position, processor 1210 instructs video adapter 1212 to control display light source 1204 and display screen 106 to display the video card as not contacting the remaining cards in stack 120. In yet another embodiment, processor 1210 receives object-light-sensor-interface-output signal 1236 representing object position 252 (shown in FIG. 2) and initially deals one of the video cards in stack 120. In still another embodiment, processor 1210 determines to initially deal upon receiving object-touch-sensor-interface-output signal 1246. In another embodiment, processor 1210 does not receive object-light-sensor-interface-output signal 1240 representing object position 302 (shown in FIG. 3) and does not determine to trigger the additional deal of one of the video cards in stack 120. In yet another embodiment, processor 1210 instructs display light source 1204 and display screen 106 to display an arrow on the display screen to show a physical device position and an orientation of physical device 104 on top surface 128.

In still another embodiment, processor 1210 determines not to trigger the additional deal upon determining that object-light-sensor-interface-output signal 1242 and object-light-sensor-interface-output signal 1238 are received within the pre-determined time window. In yet another embodiment, processor 1210 determines not to trigger the additional deal upon determining that object-light-sensor-interface-output signal 1242 and any of object-light-sensor-interface-output signals 1232, 1234, and 1236 are received within the pre-determined time window. In another embodiment, processor 1210 triggers a deal of one of the video cards from stack upon receiving object-light-sensor-interface-output signal 1232 representing object position 230 and object-light-sensor-interface-output signal 1234 representing object position 240.

Figure 13:
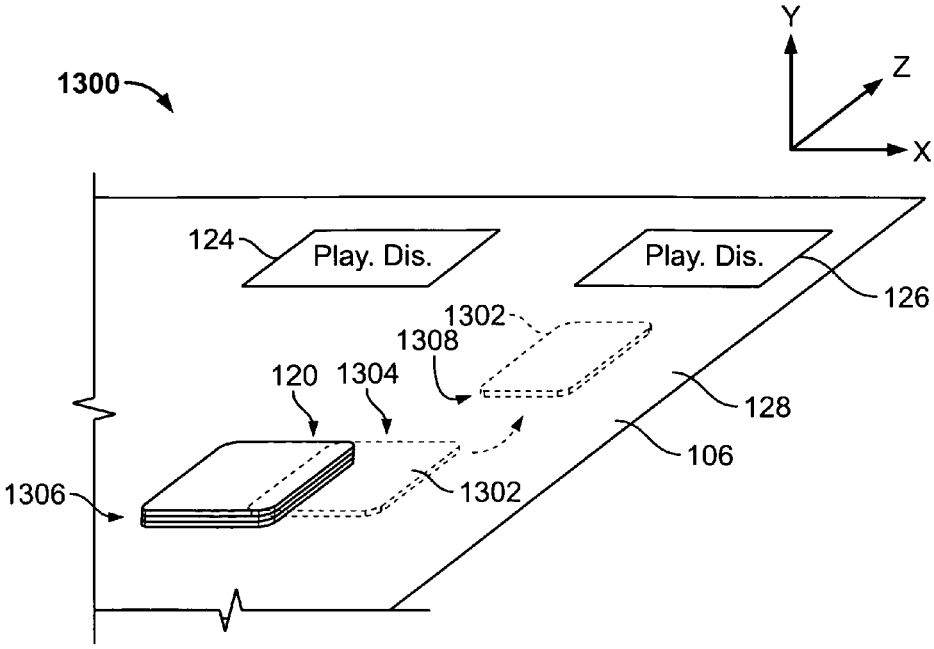
FIG. 13 is a perspective view of an alternate embodiment of a system for dealing a video card.

FIG. 13 is an isometric view of an embodiment of a system 1300 for dealing a video card. System 1300 includes display screen 106. Display screen 106 displays stack 120 and player display areas 124 and 126. A deal is triggered when a video card 1302 in stack 120 is at a video card position 1304 measured with reference to the origin that is different than remaining video card positions of a set of remaining video cards 1306 within stack 120. Video card 1302 is dealt when video card is at a video card position 1308 and does not appear to be in contact with remaining video cards 1306.

Figure 14:
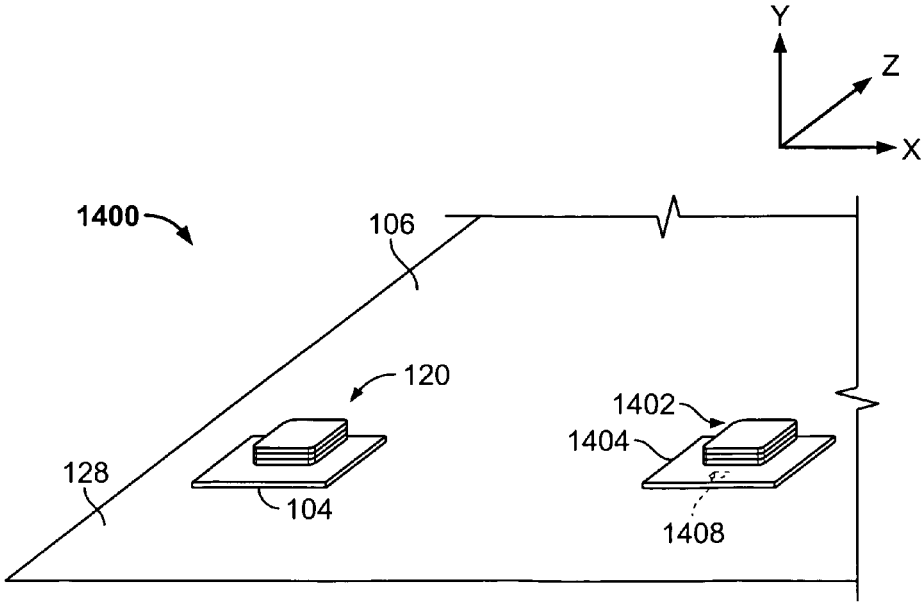
FIG. 14 is a perspective view of yet another alternate embodiment of a system for dealing a video card.

FIG. 14 is an isometric view of an embodiment of a system 1400 for dealing a video card. System includes display screen 106, stack 120, a stack 1402 of video cards, physical device 104, and a physical device 1404. Physical device 1404 has similar structure and function as that of physical device 104 and is placed on top surface 128. An identification indicia 1408 having a different identification indicia value than an identification indicia value of identification indicia 210 (shown in FIG. 2) is attached to physical device 104. Processor 1210 distinguishes physical device 104 from physical device 104 based on different identification indicia values of identification indicia 210 and 1408. Processor 1210 instructs video adapter 1212 to control display device 1202 to display stack 1402 upon determining that physical device 1404 is in contact with top surface 128. Processor 1210 determines that physical device 1404 is in contact with top surface 128 in a similar manner as that of determining that physical device 104 is in contact with top surface 128.

Processor 1210 is programmed to play a different video card game with physical device 1404 than a video card game played with physical device 104 (shown in FIG. 2). For example, processor 1210 determines from an identification indicia value of identification indicia 1408 attached to physical device 1404 that the device is used to play Poker. In the example, processor 1210 determines from an identification indicia value of identification indicia 210 attached to physical device 104 that the device is used to play Blackjack.

In another embodiment, processor 1210 determines, from identification indicia values of identification indicia 210 and 1408 attached to physical devices 104 and 1404 that the physical devices are used to play the same video card game. For example, physical device 104 is used to play Blackjack and physical device 1404 is used to play Blackjack.

Technical effects of there herein described systems and methods for dealing a video card include providing physical device 104 that has a touch and feel of dealing a physical card from a physical card stack 120. Other technical effects include providing fingerslot 404 within dealing shoe 402. A movement of finger 422 across fingerslot 404 from position 424 (shown in FIG. 4) to position 426 (shown in FIG. 4) provides the dealer with a touch and feel of triggering a deal or dealing a physical card from a physical card stack. Further, linking a trigger of a deal or a deal of a video card from stack 120 with a movement of object 214 and with a stage of a video card game prevents any mistakes by the dealer. For example, processor 1210 does not deal a video card from stack 120 upon receiving object-light-sensor-interface-output signal 1238 and determining that a state of a video card game does not permit the dealer to deal the video card. Moreover, other technical effects include reducing chances of collusion of the dealer with a player playing at one of player display areas 124 and 126. The changes of collusion are reduced by not allowing the dealer to deal physical cards and by using physical device 104 to facilitate a deal of a video card from stack 120. Further technical effects include reducing chances of a misdeal, such as a chance of a misdeal occurring from an item accidentally dropping on physical device 104. Examples of the item include a keychain and an ornament. Processor 1210 determines whether an item parameter of the item is within the pre-defined range and upon determining that the item parameter is not within the pre-defined range, processor 1210 does not trigger a deal of a video card from stack 120.

While the invention has been described in terms of various specific embodiments, those skilled in the art will recognize that the invention can be practiced with modification within the spirit and scope of the claims.

What is claimed is:

1. A physical device comprising:

a surface that includes a light reflective area that reflects light when an object passes over the light reflective area, the light reflective area defined by an outer border that circumscribes the light reflective area and that extends to an edge of the physical device;

wherein the physical device is configured to trigger a deal of a video card on a display screen of a gaming table by allowing light reflecting off of the object to be optically detected by a light sensor when the object has moved across a portion of the outer border of the light reflective area that extends to the edge of the physical device.

2. A physical device in accordance with claim 1, wherein the physical device does not include a display device configured to display an image of a stack of video cards.

3. A physical device in accordance with claim 1, wherein said physical device is attached to at least one identification indicia configured to uniquely identify the physical device.

4. A physical device in accordance with claim 1, wherein said physical device is configured to be placed on the gaming table that displays a stack of video cards.

5. A physical device in accordance with claim 1, wherein said physical device is configured to be placed on the gaming table that displays a stack of video cards, wherein the stack of video cards is configured to move in the same direction as that of the physical device.

6. A physical device in accordance with claim 1, wherein the physical device is made of at least one of a plastic and a combination of a metal and the plastic.

7. A physical device in accordance with claim 1, wherein the physical device is fabricated from a reflective material.

8. A physical device in accordance with claim 1, wherein the physical device comprises a finger slot configured to receive a movement of a finger.

9. A system for dealing a video card, said system comprising:

a gaming table having a display screen configured to display a stack of video cards;

a physical device comprising a surface that includes a light reflective area that reflects light when an object passes over the light reflective area, wherein the light reflective area is defined by an outer border that circumscribes the light reflective area, a portion of the outer border extending to an edge of the physical device, said physical device configured to be placed on said gaming table; and a processor configured to trigger a deal of one of the video cards from the stack upon receiving information the object has been optically detected as moving across the portion of the outer border of the light reflective area that extends to the edge of the physical device.

10. A system in accordance with claim 9, further comprising a sensor system configured to sense a placement of said physical device on said gaming table.

11. A system in accordance with claim 9, further comprising a sensor system configured to sense a placement of said physical device on said gaming table from an identification indicia attached to said physical device.

12. A system in accordance with claim 9, further comprising a sensor system configured to generate a signal upon sensing a placement of said physical device on said gaming table, wherein said processor is programmed to enable the stack of video cards to be displayed upon receiving the signal from said sensor system.

13. A system in accordance with claim 9, wherein said physical device is configured to move on said gaming table.

14. A system in accordance with claim 9, further comprising a sensor system configured to generate a first signal upon sensing contact of the object with said physical device, wherein said sensor system is configured to generate a second signal upon sensing contact of the object with said gaming table, wherein said processor is configured to deal the one of the video cards upon receiving the first and second signals.

15. A system in accordance with claim 9, further comprising a sensor system configured to generate a first signal upon sensing contact of the object with said physical device, wherein said sensor system is configured to generate a second signal upon sensing contact of the object with said gaming table, wherein said processor is configured to deal the one of the video cards upon receiving the first and second signals and upon determining that the object has a parameter within a range.

16. A system in accordance with claim 9, wherein said processor is configured to deal the one of the video cards independent of whether the object contacts said physical device and based on a state of a video card game played by using the stack of video cards.

17. A system for dealing a video card, said system comprising:

a gaming table having a display screen configured to display a first stack of video cards;

a first physical device comprising a surface that includes a light reflective area that reflects light when an object passes over the light reflective area, wherein the light reflective area is defined by an outer border that circumscribes the light reflective area, a portion of the outer border extending to an edge of the first physical device, said first physical device configured to be placed on said gaming table; and a processor configured to deal one of the plurality of video cards from the first stack upon determining, through a light sensor, that light reflecting off of the object is indicative that the object has moved across the portion of the outer border of the light reflective area that extends to the edge of the physical device;

wherein the object is moved across the light reflective area by a person.

18. A system in accordance with claim 17, further comprising a second physical device configured to be placed on said gaming table, wherein said gaming table is configured to display a second stack of video cards upon placement of the second physical device on said gaming table.

19. A system in accordance with claim 17, further comprising a second physical device configured to be placed on said gaming table, wherein said gaming table is configured to display a second stack of video cards upon placement of the second physical device on said gaming table, wherein the first stack is used to play a card game that is different than a card game played by using the second stack.

20. A system in accordance with claim 17, wherein said first physical device comprises a nonabrasive surface that is in contact with said gaming table.

21. A method for dealing a video card, said method comprising:

placing a physical device on a gaming table, wherein the gaming table includes a display screen configured to display a stack of video cards, the physical device comprising a surface that includes a light reflective area that reflects light when an object passes over the light reflective area, wherein the light reflective area is defined by an outer border that circumscribes the light reflective area, a portion of the outer border extending to an edge of the first physical device; and triggering, via a processor, a deal of one of a plurality of video cards from the stack of video cards upon determining that light reflecting off of the object is indicative that the object has moved across the portion of the outer border of the light reflective area that extends to the edge of the first physical device.

22. A method in accordance with claim 21, further comprising:

determining whether the object contacts the gaming table; and dealing the one of the video cards upon determining that the object contacts the gaming table.

23. A method for dealing a video card, said method comprising:

placing a physical device on a gaming table, wherein the gaming table includes a display screen configured to display a stack of video cards, the physical device comprising a surface that includes a light reflecting area that allows light reflecting off an object to pass through the physical device when the object passes over the light reflecting area, wherein the light reflective area is defined by an outer border that circumscribes the light reflective area, a portion of the outer border extending to an edge of the first physical device; and dealing one of a plurality of video cards from the stack upon optically determining, via a processor, that light reflecting off of the object is indicative that the object has moved across the portion of the outer border of the light reflective area that extends to the edge of the physical device.

24. A method in accordance with claim 23, further comprising:

determining whether a time period between said dealing and a trigger of a deal of another one of the video cards is within a time window; and preventing dealing of the other one of the video cards upon determining that the time period is within the time window.

25. The physical device of claim 1, wherein the physical device has the appearance of a card shoe, wherein the light reflective area is a finger slot configured to receive a finger, and wherein the object is the finger.

26. A system for playing a video card table game comprising:

a gaming table having a touch sensitive display screen;

a dealing shoe including a top surface and a bottom surface, wherein the top surface and the bottom surface are spaced apart by a distance, wherein the bottom surface is in contact with the touch sensitive display screen, the dealing shoe including a fingerslot, wherein the fingerslot includes a groove that extends down an angled surface connecting the top surface and the bottom surface, wherein the angled surface intersects the top surface and the bottom surface at non-perpendicular angles; and a processor configured to:

determine when a finger or an object slides from approximately the top surface to the bottom surface along the fingerslot, and in response, deal a video card from a displayed first stack of video cards displayed on the display screen.

* * * * *